US009333757B2

(12) United States Patent
Takagiwa

(10) Patent No.: US 9,333,757 B2
(45) Date of Patent: May 10, 2016

(54) LIQUID-HOLDING CONTAINER AND CARTRIDGE

(71) Applicant: BROTHER KOGYO KABUSHIKI KAISHA, Nagoya-shi, Aichi (JP)

(72) Inventor: Yutaka Takagiwa, Kariya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/582,862

(22) Filed: Dec. 24, 2014

(65) Prior Publication Data

US 2015/0273840 A1 Oct. 1, 2015

(30) Foreign Application Priority Data

Mar. 31, 2014 (JP) ..... 2014-073637
Nov. 25, 2014 (JP) ..... 2014-237685

(51) Int. Cl.
*B41J 2/175* (2006.01)

(52) U.S. Cl.
CPC ..... *B41J 2/1752* (2013.01); *B41J 2/175* (2013.01); *B41J 2/17513* (2013.01); *B41J 2002/17516* (2013.01)

(58) Field of Classification Search
CPC ..... B41J 2/17513; B41J 2/17516; B41J 2/17556; B41J 2/1754
See application file for complete search history.

(56) References Cited

U.S. PATENT DOCUMENTS 4,760,409 A * 7/1988 Kiyohara ..... B41J 2/17523 347/86
8,608,299 B1 12/2013 Lu et al.
2004/0012659 A1 1/2004 Perkins et al.
2004/0160481 A1 8/2004 Miyazawa et al.
2011/0199439 A1 8/2011 Aoki
2012/0249696 A1 10/2012 Mizuno

FOREIGN PATENT DOCUMENTS

CN 1349894 A 5/2002
CN 102161276 A 8/2011
EP 1382452 A1 1/2004
JP 2012-210729 A 11/2011

OTHER PUBLICATIONS

Chinese Office Action issued on Feb. 15, 2016 in the Chinese Patent Application No. 201510107813.5 corresponding to teh present application.

* cited by examiner

*Primary Examiner* — Geoffrey Mruk
(74) *Attorney, Agent, or Firm* — Fox Rothschild LLP

(57) ABSTRACT

A liquid-holding container includes a liquid container portion, a hollow vent plug, a first projecting portion, and a second projecting portion. The liquid container portion is flexible and configured to contain a liquid. The hollow vent plug is connected to the liquid container portion. The first projecting portion is connected to the vent plug and extends in a direction that intersects a face of the liquid container portion. The second projecting portion is connected to the vent plug on the opposite side of the vent plug from the first projecting portion. The length of the second projecting portion from a face that includes an axis of the vent plug is shorter than a length of the first projecting portion.

15 Claims, 18 Drawing Sheets

LIQUID-HOLDING CONTAINER AND CARTRIDGE

CROSS-REFERENCE TO RELATED APPLICATION

This application claims priority to Japanese Patent Applications No. 2014-73637, filed Mar. 31, 2014, and No. 2014-237685, filed Nov. 25, 2014. The disclosure of the foregoing applications is incorporated herein, by reference in its entirety.

BACKGROUND

The present disclosure relates to a liquid-holding container that is configured to contain a liquid and to a cartridge that is provided with the liquid-holding container.

In related art, a liquid-holding container that is configured to contain a liquid and a cartridge that is provided with the liquid-holding container are known. For example, a known ink cartridge is provided with an ink bag that can contain an ink that, is a liquid and with a case that can contain the ink bag. The ink bag is provided with a vent plug that draws out the ink that is contained in the ink bag. The case is provided with a first middle leg and a second middle leg. The first middle leg and the second middle leg project from the outer surface of a left wall of the case. The first middle leg and the second middle leg are provided in a range that corresponds to the color of the ink that is contained inside the case and function as an ink color indicator portion.

SUMMARY

The types of the ink in the ink bag differ according to color, viscosity, and the like. The known ink cartridge is provided with the color indicator portion on the case to determine the color. Because the color indicator portion is not provided on the ink bag, in a case where the ink bag is provided individually, it is not possible to determine the type of the ink in the ink bag. For example, in a case where the ink bag is not transparent and the ink inside the ink bag cannot be seen, it is not possible to determine the color of the ink. Even in a case where the ink bag is transparent, a case occurs in which the type of the ink inside the ink bag cannot be visually determined.

Various embodiments of the broad principles derived herein provide a liquid-holding container that enables the type of the liquid to be determined and also provides a cartridge that is provided with the liquid-holding container.

The embodiments herein provide a liquid-holding container that includes a liquid container portion, a hollow vent plug, a first projecting portion, and a second projecting portion. The liquid container portion is flexible and configured to contain a liquid. The hollow vent plug is connected to the liquid container portion. The first projecting portion is connected to the vent plug and extends in a direction that intersects a face of the liquid container portion. The second projecting portion is connected to the vent plug on the opposite side of the vent plug from the first projecting portion. The second projecting portion extends in the direction that intersects the face of the liquid container portion, such that the second projecting portion is opposite the first projecting portion. The length of the second projecting portion from a face that includes an axis of the vent plug is shorter than a length of the first projecting portion.

The embodiments herein also provide a cartridge that includes a liquid-holding container and a case. The liquid-holding container includes a liquid container portion, a hollow vent plug, a first projecting portion, and a second projecting portion. The liquid container portion is flexible and configured to contain a liquid. The hollow vent plug is connected to the liquid container portion. The first projecting portion is connected to the vent plug and extends in a direction that intersects a face of the liquid container portion. The second projecting portion is connected to the vent plug on the opposite side of the vent plug from the first projecting portion. The second projecting portion extends in the direction that intersects the face of the liquid container portion, such that the second projecting portion is opposite the first projecting portion. The length of the second projecting portion from a face that includes an axis of the vent plug is shorter than a length of the first projecting portion. The case is configured to support the liquid-holding container and includes a supporting wall portion and a first opening. The supporting wall portion is configured to support the liquid-holding container and extends in the axial direction of the vent plug. The first opening is provided on one end of the supporting wall portion in the axial direction and is an opening into which the first projecting portion can protrude.

BRIEF DESCRIPTION OF THE DRAWINGS

Embodiments of the present disclosure will be described below in detail with reference to the accompanying drawings in which.

DETAILED DESCRIPTION

An embodiment of the present disclosure will be explained with reference to the drawings. An overall configuration of a printer 1 will be explained with reference to FIGS. 1 to 3. In the explanation that follows, the top, the bottom, the lower right, the upper left, the upper right, and the lower left is FIG. 1 define the top, the bottom, the right, the left, the rear, and the front of the printer 1.

Figure 1:
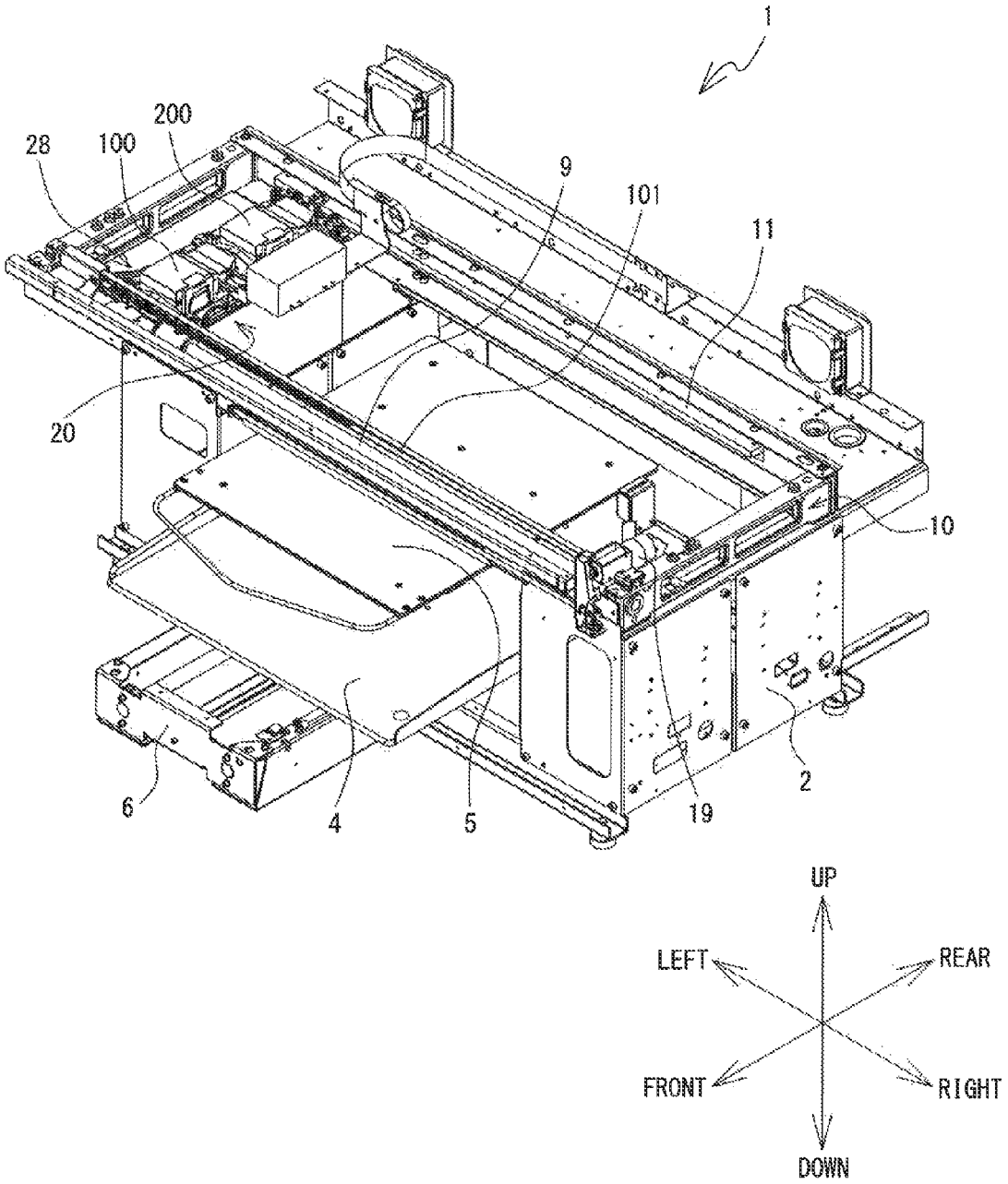
FIG. 1 is an oblique view of a printer.

As shown in FIG. 1, the printer 1 is an inkjet printer that discharges art ink that is a liquid onto a cloth such as a T-shirt or the like (not shown in the drawings) that is a printing medium. The printing medium may also be a paper or the like. The printer 1 of the present embodiment prints a color image on the printing medium by emitting five different types of the ink downward. The five types of the ink are white, black, yellow, cyan, and magenta.

The printer 1 is mainly provided with a housing 2, a platen drive mechanism 6, a platen 5, a tray 4, a frame body 10, a guide shaft 9, a rail 11, a carriage 20, a support portion (not shown in the drawings), head units 100 and 200, a drive belt 101, and a drive motor 19. The housing 2 is substantially a three-dimensional rectangle whose long axis extends from left to right. An operation portion, (not shown in the drawings) that performs operations of the printer 1 is provided on the front right portion of the housing 2. The operation portion is provided with a display and operation burtons. The display displays various types of information. A user operates the operation buttons when inputting commands that are related to various types of operations of the printer 1. The platen drive mechanism 6 is provided in its interior with a pair of guide rails (not shown, in the drawings) that extend from the front to the rear. The pair of the guide rails support the platen 5 and the tray 4 such that the platen. 5 and the tray 4 can be conveyed toward the front and the rear. The platen drive mechanism 6 moves the platen 5 and the tray 4 toward the front and the rear of the housing 2 along the pair of the guide rails, with a motor (not shown in the drawings) that is provided at the rear end of the platen drive mechanism 6 serving as a drive source. The platen 5 is a plate that is substantially rectangular in a plan view, and its long axis extends toward the front and the rear of the housing 2. The platen 5 is provided below the frame body 10. The printing medium, which may be a cloth such as a T-shirt or the like, for example, is placed on the top face of the platen 5. The tray 4 is substantially rectangular in a plan view, and it is provided below the platen 5. The tray 4 receives the sleeves and the like of the T-shirt that has been placed on the platen 5, so the sleeves and the like do not fall into the interior of the housing 2. The frame body 10 has a frame shape that is substantially rectangular in a plan view. The frame body 10 is installed in the top portion of the housing 2. The frame body 10 supports the guide shaft 9 and the rail 11. The guide shaft 9 is a shaft member that extends to the left and the right. The rail 11 is a rod-shaped member that is disposed to the rear of the guide shaft 9 and extends to the left and the right. The guide shaft 9 and the rail 11 are separated from one another in the front-rear direction. The guide shaft 9 supports the carriage 20 such that the carriage 20 can be conveyed to the left and the right. The carriage 20 carries the head units 100 and 200. A head portion (not shown in the drawings) is provided on the bottom face of each of the head units 100 and 200. In conjunction with the operation of a piezoelectric element each one of the head portions discharges droplets of the ink downward from a plurality of tiny nozzles (not shown in the drawings).

The drive belt 101 spans the frame body 10 in the left-right direction. The drive belt 101 is made of a flexible resin. The drive motor 19 is provided in the front right portion of the frame body 10. The drive motor 19 is provided between the guide shaft 9 and the rail 11 in the front-rear direction. The drive motor 19 is capable of rotating forward and to reverse, and it is coupled to the carriage 20 via the drive belt 101. When the drive motor 19 drives the drive belt 101, the carriage 20 moves in a reciprocating manner to the left and the right. Therefore, the respective bead portions of the head units 100 and 200 move in a reciprocating manner to the left and the tight. The head portions that move in a reciprocating manner to the left and the right discharge the ink onto the printing medium while the platen 5 conveys the printing medium toward the front and the rear.

Figure 2:
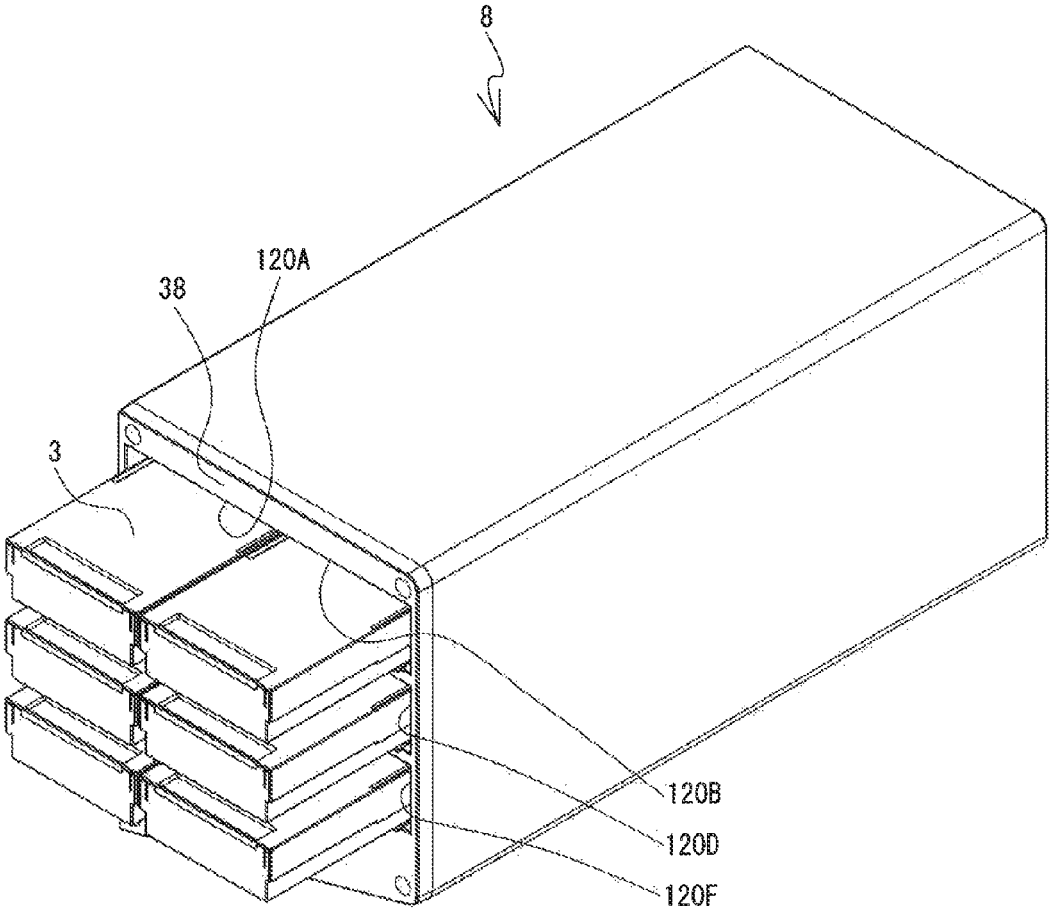
FIG. 2 is an oblique view of a cartridge mounting portion in which cartridges are mounted.

A cartridge mounting pardon 8 that is shown in FIG. 2 is provided on the right side of the printer 1. The housing 2 supports the cartridge mounting portion 8. Cartridges 3 that are mounted in the cartridge mounting portion 8 supply the inks to the respective head portions of the head units 100 and 200. A plurality of the cartridges 3 is configured to be mounted in the cartridge mounting portion 8. In the present embodiment, six of the cartridges 3 are mounted.

Figure 3:
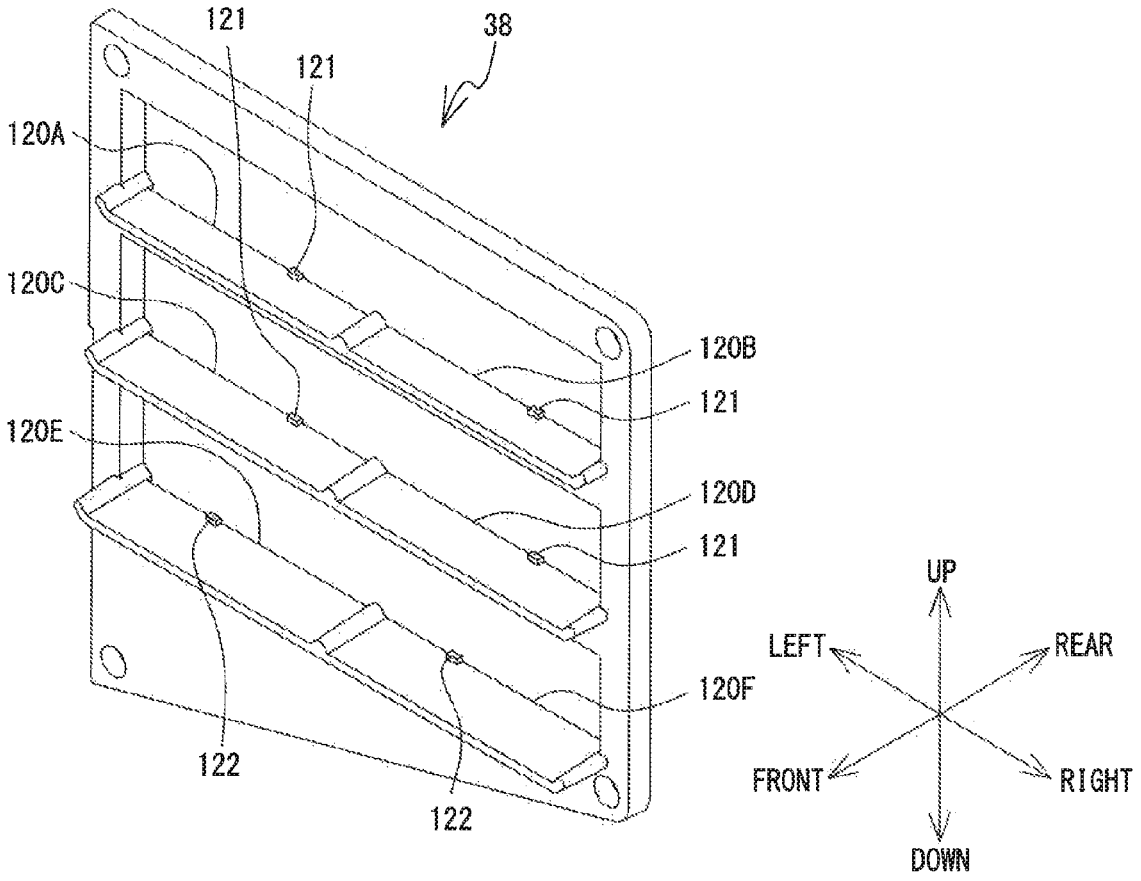
FIG. 3 is an oblique view of a frame portion of the cartridge mounting portion.

As shown in FIG. 3, a frame portion 38 is provided in the front portion of the cartridge mounting portion 8. Openings 120A to 120F are provided in the frame portion 38. The cartridges 3 are inserted into and removed from the openings 120A to 120F. The openings 120A to 120F are arrayed in three rows in the up-down direction and two columns in the left-right direction. A protuberance 121 is provided in the bottom portion of each one of the upper four openings 120A to 120D. A protuberance 122 is provided in the bottom portion of each one of the lower two openings 120E and 120F. Each of the protuberances 121 and 122 projects upward. The openings 120A to and 120B, the openings 120C and 120D, and the openings 120E and 120F are arrayed from the left side to the right side, respectively. Each of the protuberances 121 in the openings 120A and 120C is positioned farther to the right than the protuberance 122 in the opening 120E. Each of the protuberances 121 in the openings 120B and 120D is positioned, farther to the right than the protuberance 122 in the opening 120F.

Figure 4:
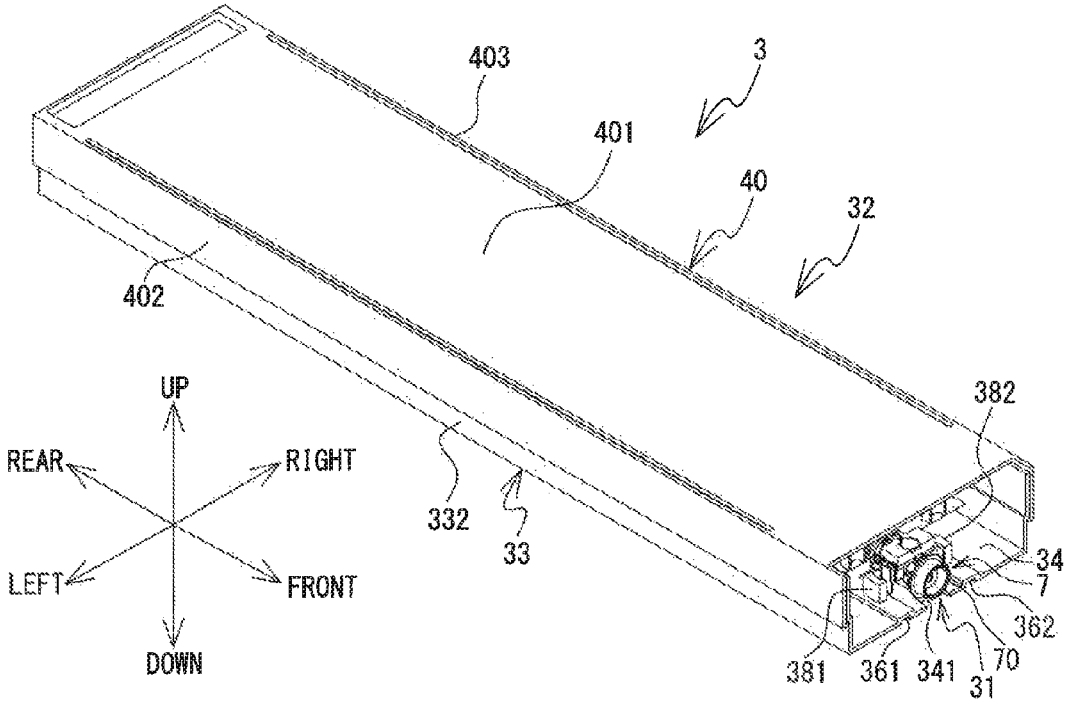
FIG. 4 is an oblique view of the cartridge.
Figure 7:
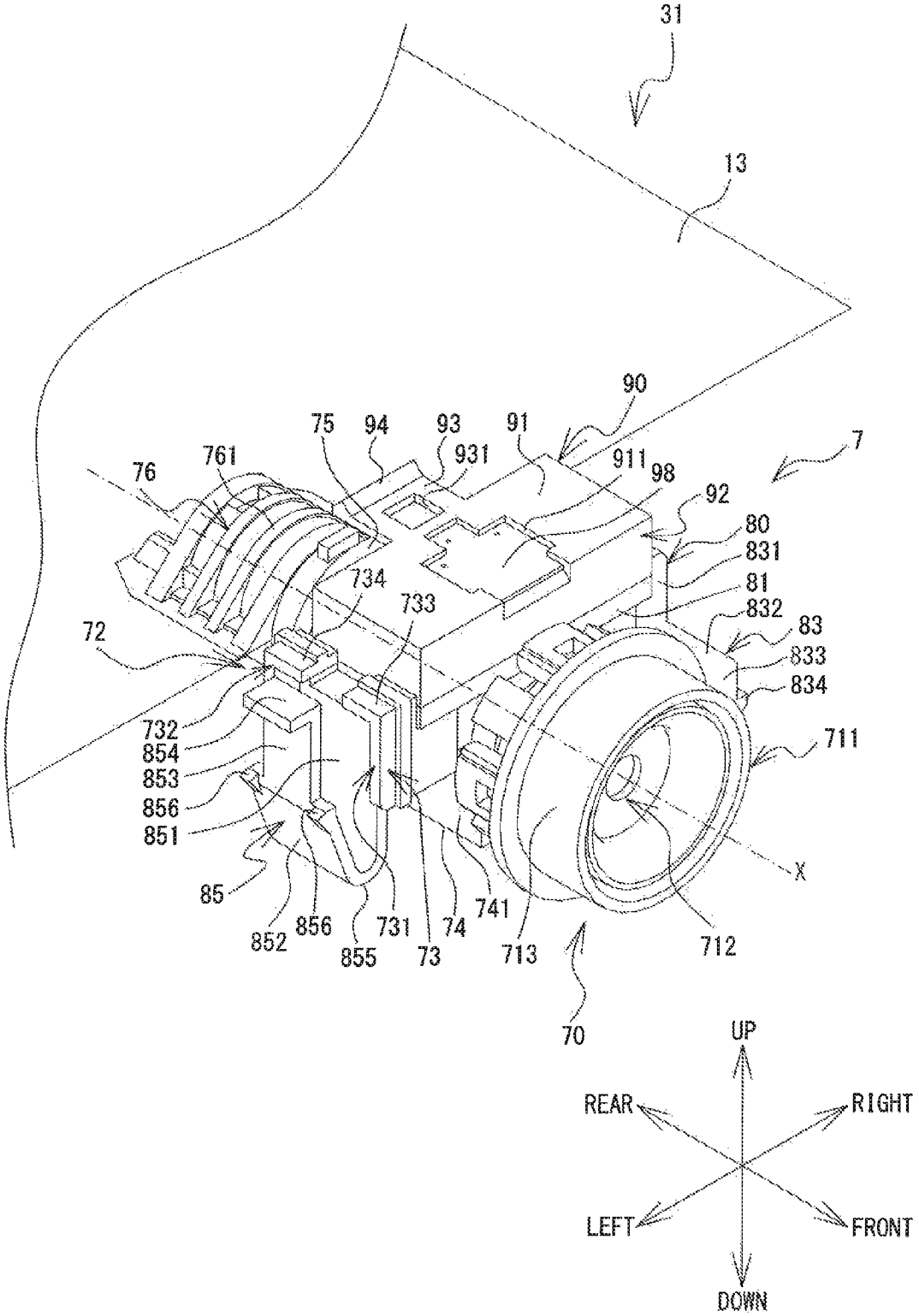
FIG. 7 is an oblique view of a vent plug unit in which an attaching portion is in a first orientation.

As shown in FIG. 4, when the cartridge 3 is mounted in the cartridge mounting portion 8 through any one of the openings 120A to 120D, the corresponding protuberance 121 passes through a groove 361 of the cartridge 3 (to be described later). When the cartridge 3 is mounted in the cartridge mounting portion 8 through either one of the openings 120E and 120F, the corresponding protuberance 122 passes through a groove 362 of the cartridge 3 (to be described later). When the cartridge 3 is mounted in the cartridge mounting portion 8, a hollow needle 106 shown in FIG. 16 pierces a rubber plug (not shown in the drawings). The rubber plug is in a vent plug 70 of a liquid-holding container 31, which is shown in FIG. 7. The hollow needle 106 is a needle that draws a liquid out of the liquid-holding container 31.

Figure 5:
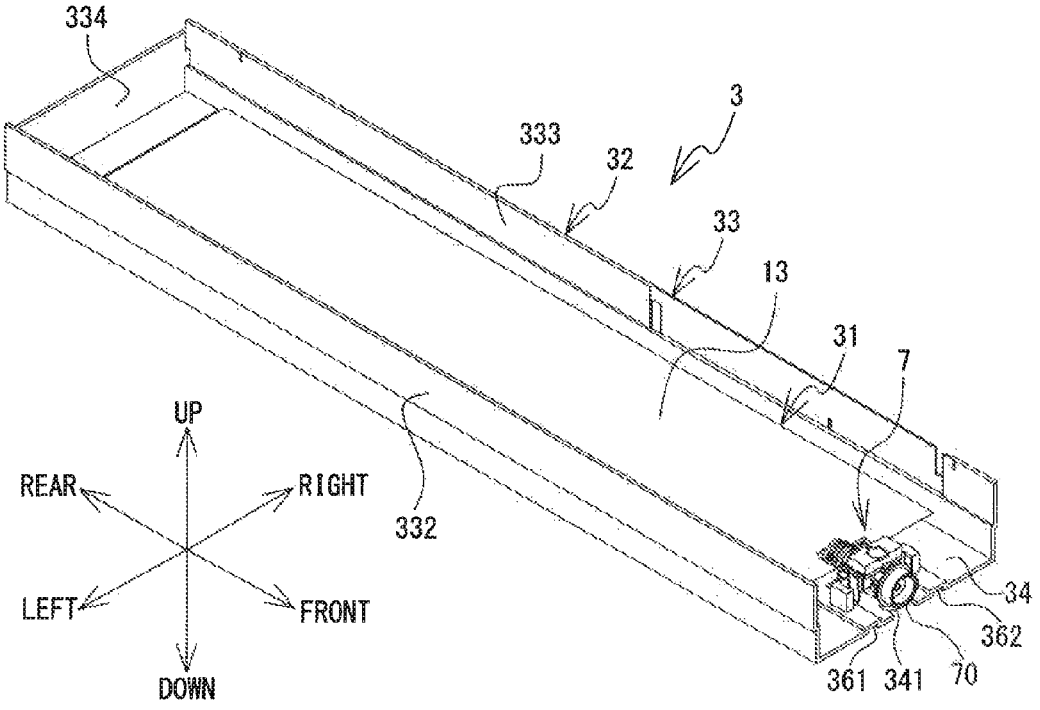
FIG. 5 is an oblique view of the cartridge, with a second case removed.

The cartridge 3 will be explained with reference to FIGS. 4 to 16. In the explanation that follows, the top, the bottom, the lower right, the upper left, the upper right, and the lower left in FIG. 4 respectively define the top, the bottom, the front the rear, the right, and the left of the cartridge 3. As shown in FIGS. 4 and 5, the cartridge 3 is provided with the liquid-holding container 31 and a case 32. The case 32 accommodates the liquid-holding container 31 in its interior.

Figure 6:
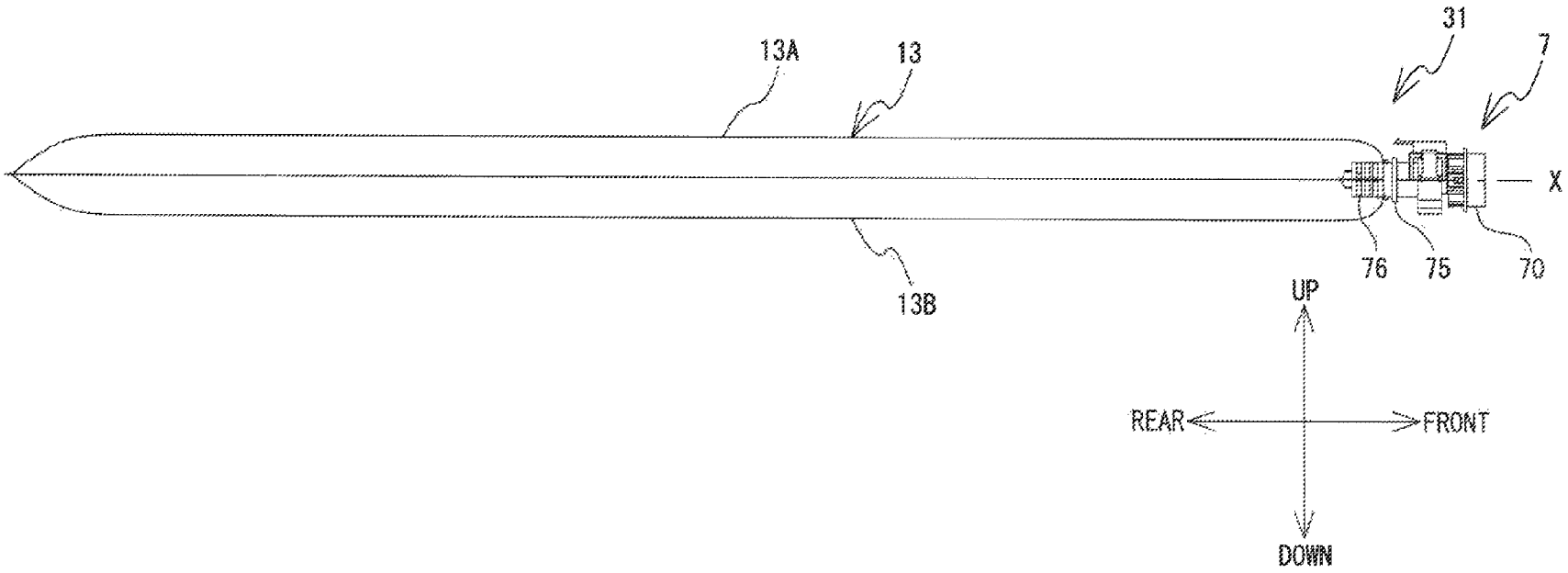
FIG. 6 is a left side view of a liquid-holding container that contains a liquid.

As shown in FIG. 5, the liquid-holding container 31 is provided with a liquid-holding bag 13 and a vent plug unit 7. As shown in FIG. 6, the liquid-holding bag 13 is a bag-shaped container that is formed from two sheets 13A and 13B. The two sheets 13A and 13B are made of flexible resin and are rectangular. The peripheral edges of the two sheets 13A and 13B are thermally welded in a state in which faces of the two sheets 13A and 13B are caused to face each other.

The liquid-holding bag 13 is configured to contain various types of liquid in its interior. The liquid in the present embodiment is an ink. When a large amount of the ink is contained in the liquid-holding bag 13, the sheets 13A and 13B are curved in directions in which they are separated from one another, as shown in FIG. 6. When a small amount of the ink is contained in the liquid-holding bag 13, the sheets 13A and 13B slacken in the direction in which the distance between them narrows and they touch one another. In the drawings other than FIG. 6, the liquid-holding bag 13 is shown in a state in which it does not contain the ink, but it does actually contain the ink. The liquid-holding bag 13 is not shown in FIG. 16.

Figure 8:
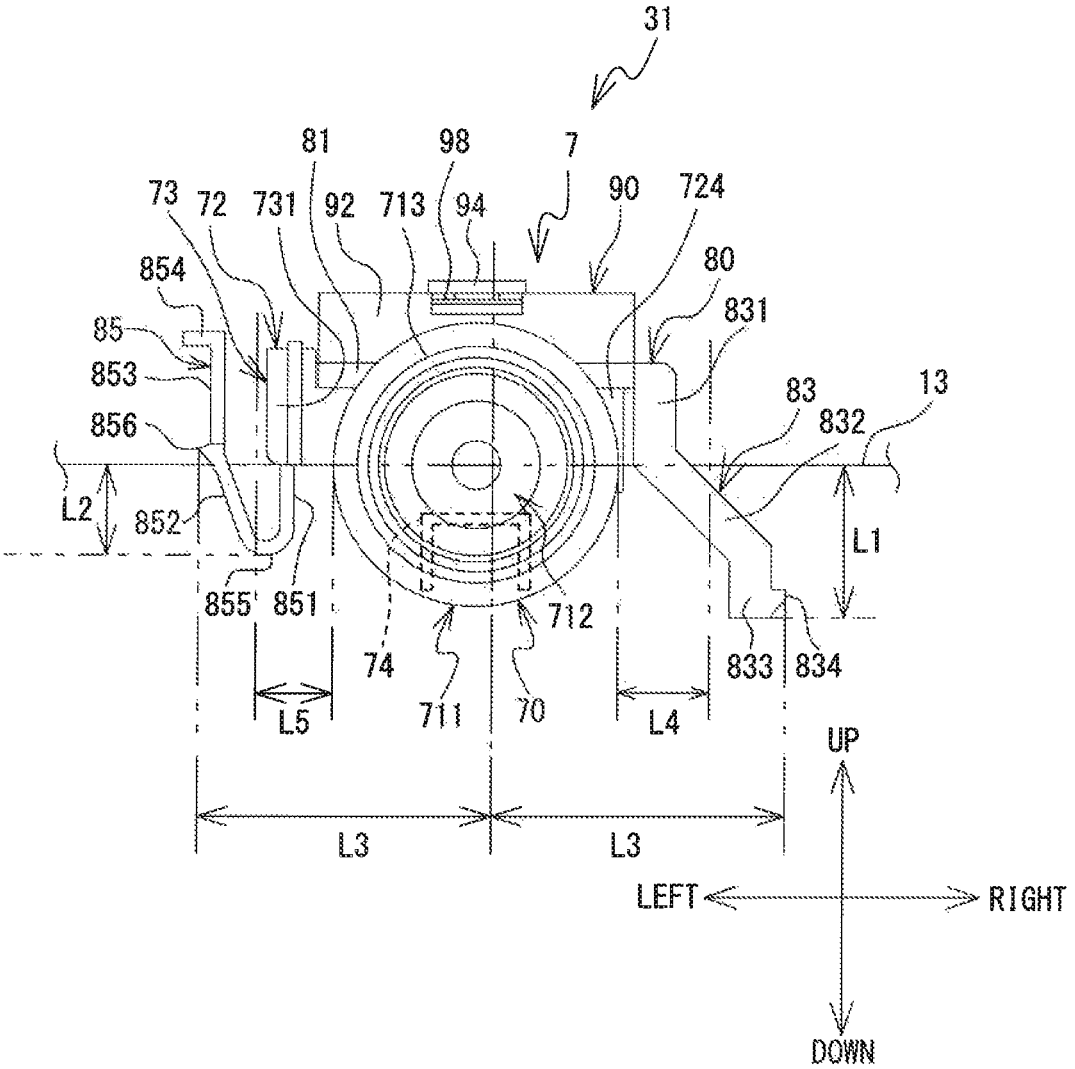
FIG. 8 is a front view of the vent plug unit in which the attaching portion is in the first orientation.

The overall configuration of the vent plug unit 7 will be explained. As shown in FIGS. 6 and 7, the vent plug unit 7 is provided with the vent plug 70. The vent plug 70 is connected to the liquid-holding bag 13 and extends in the front-rear direction, which is the X axis direction. The X axis direction is substantially parallel to the long axis of the liquid-holding bag 13 in the front-rear direction. As shown in FIGS. 7 and 8, the vent plug 70 is connected to a first projecting portion 83 and a second projecting portion 85. The first projecting portion 83 is provided on the right side of the vent plug 70. The second projecting portion 85 is provided on the opposite side from the first projecting portion 83, which is the left side of the vent plug 70, such that the vent plug 70 is between the first projecting portion 83 and the second projecting portion 85. The first projecting portion 83 and the second projecting portion 85 are arrayed in the left-right direction and extend in a direction in which they intersect with the faces of the sheets 13A and 13B of the liquid-holding bag 13. Furthermore, the first projecting portion 83 and the second projecting portion 85 extend in the downward direction, which is orthogonal to the X axis direction.

In the explanation that follows, the downward direction in which the mutually opposed first projecting portion 83 and second projecting portion 85 extend will be called the projecting direction in some cases. The length of the second projecting portion 85 in the projecting direction from a plane that passes through the X axis and extends in the left-right direction is shorter than the length of the first projecting portion 83 in the projecting direction. The first projecting portion 83 engages with a first opening 372 that is provided in the case 32. The second projecting portion 85 engages with a second opening 391 that is provided in the case 32. The liquid-holding container 31 is thus mounted in the case 32 (refer to FIG. 10).

Figure 9:
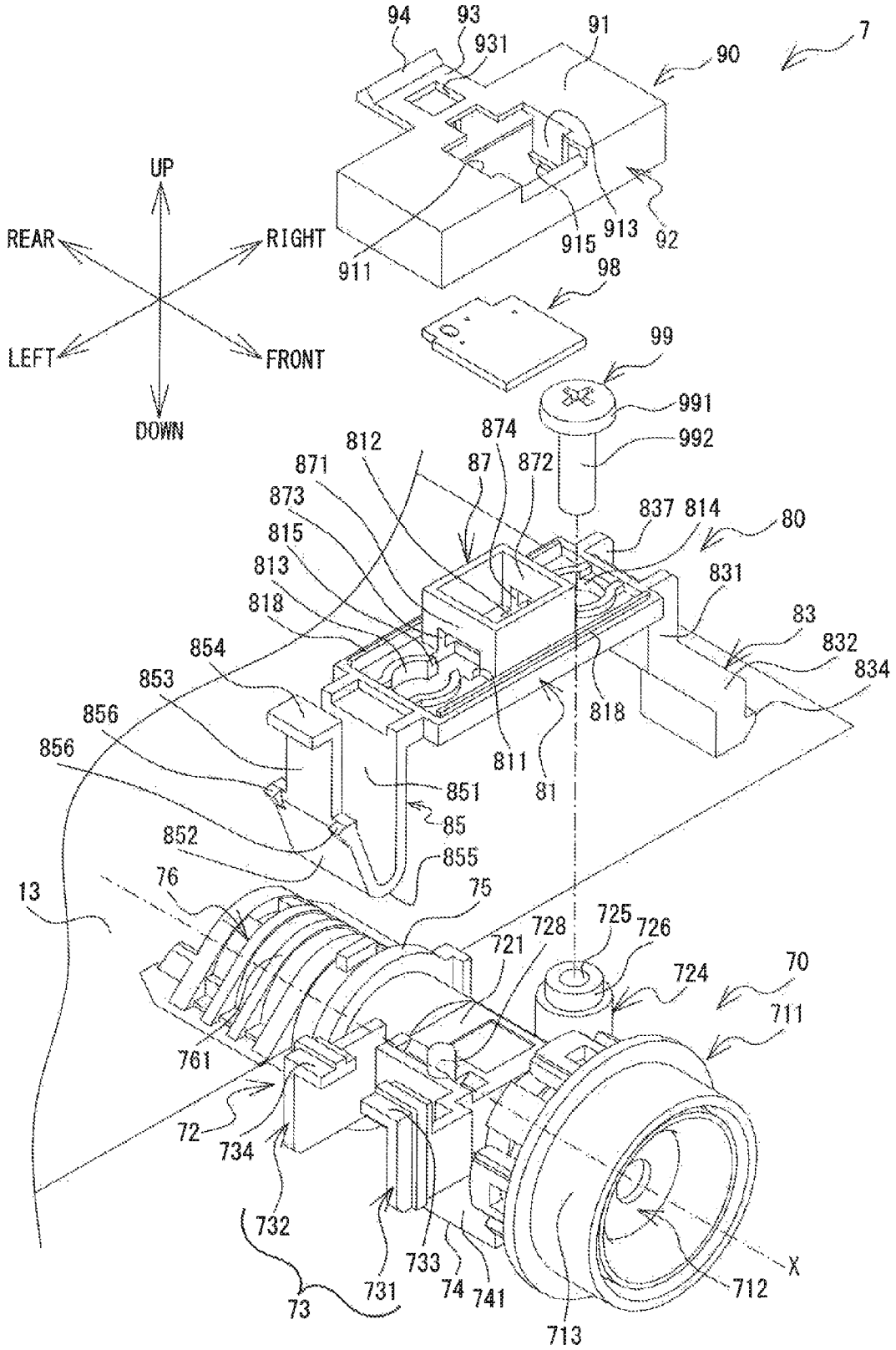
FIG. 9 is an exploded oblique view of the vent plug unit in which the attaching portion is in the first orientation.

A configuration of the vent plug unit 7 will be explained with reference to FIGS. 7 to 11. As shown in FIGS. 7 to 9, the vent plug unit 7 is provided with the vent plug 70, an attaching portion 80, a holder 90, an electric circuit board 98, and a screw 99 shown in FIG. 9. As shown in FIG. 9, the vent plug 70 is provided with a main body portion 711. The main body portion 711 has a circular cylindrical shape that extends in the X axis direction. The main body portion 111 is provided with a hollow portion 712. The hollow portion 712 extends through, the main body portion 711 in the X axis direction. The hollow portion 712 connects the interior of the liquid-holding bag 13 with the outside. The rubber plug (not shown in the drawings) is disposed in a portion of the hollow portion 712 in the X axis direction, so the ink that is inside the liquid-holding bag 13 does not leak out.

The front end portion of the main body portion 711 is a tip portion 713. The tip portion 713 has a circular cylindrical shape that extends in the X axis direction. A support portion 72 and a first mounting portion 74 are provided to the rear of the tip portion 713. The support portion 72 supports the attaching portion 80. The support portion 72 is provided with a flat portion 721, a support arm 73, a protruding portion 728, and a cylindrical portion 724. The flat portion 721 is provided on the top face of the main body portion 711. The cylindrical portion 724 is provided to the right of the main body portion 711 and extends in the up-down direction. A tip portion 726 is provided on the upper end of the cylindrical portion 724. The tip portion 726 is a cylindrical portion whose axis coincides with that of the cylindrical portion 724. The diameter of the tip portion 726 is smaller than the diameter of the cylindrical portion 724. The cylindrical portion 724 and the tip portion 726 are provided with a thread groove 725. The thread groove 725 runs downward from the top face of the tip portion 726 through the interior of the cylindrical portion 724. The protruding portion 728 is provided to the left of the flat portion 721. The protruding portion 728 is a circular column that protrudes upward and has a rounded tip.

The support arm 73 is provided with a first arm portion 731 and a second arm portion 732 that face each other in front-rear direction. The first arm portion 731 and the second arm portion 732 project to the left from the main body portion 711, and their left ends extend upward. A wall portion 733 is provided on the upper left end of the first arm portion 731. The wall portion 733 extends toward the rear. A wall portion 734 is provided on the upper left end of the second arm portion 732. The wall portion 734 extends toward the front.

Figure 10:
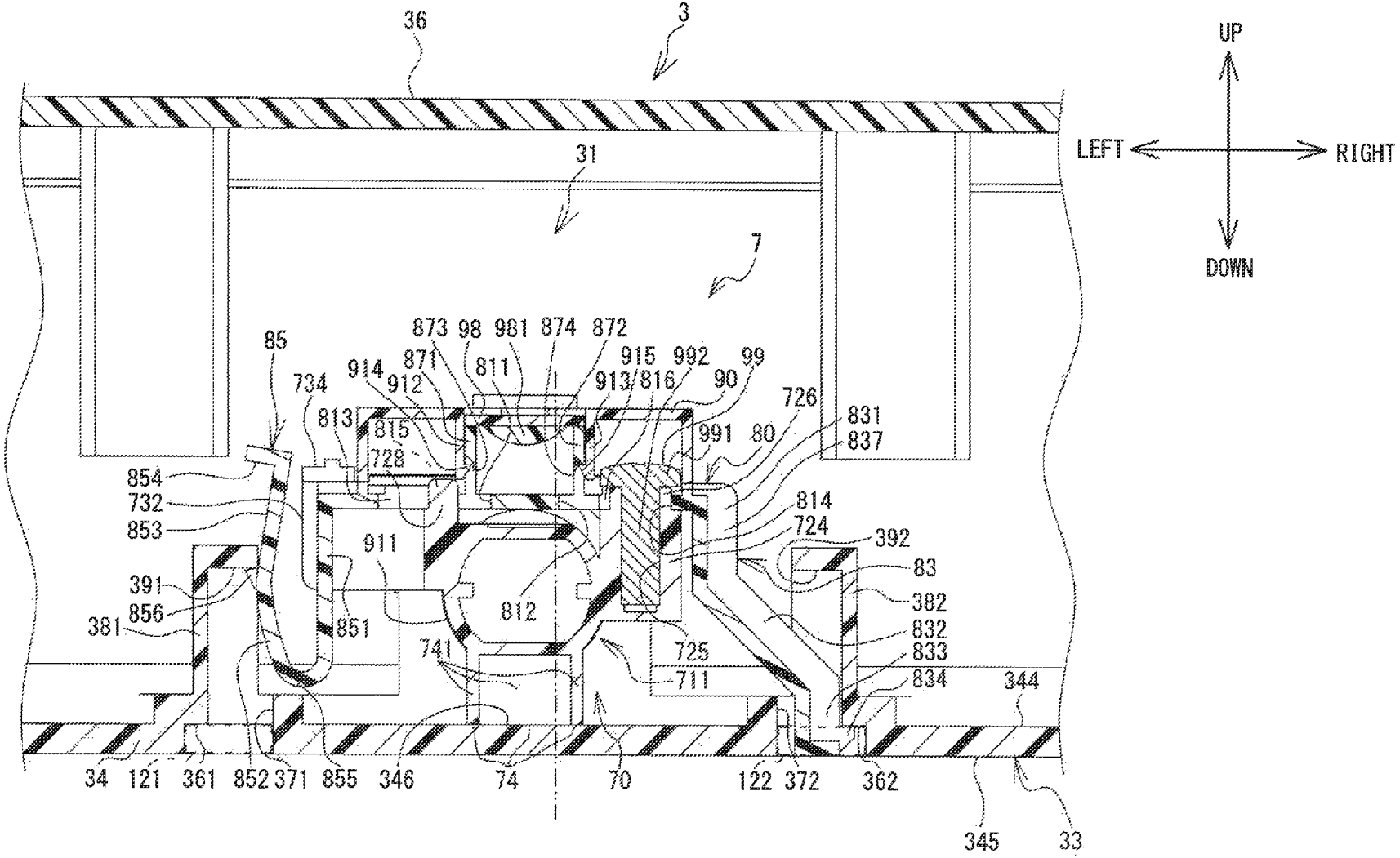
FIG. 10 is a vertical section view of the cartridge, including the vent plug unit in which the attaching portion is in the first orientation.

As shown in FIGS. 9 and 10, the first mounting portion 74 is provided on the outside face of the vent plug 70. Wall portions 741 project downward from the lower rear of the tip portion 713, forming a rectangular shape in a plan view. The lower edges of the wall portions 741 are connected to the periphery of the first mounting portion 74. The first mounting portion 74 is a flat portion that is on the lower edges of the wall portions 741, and it extends in the left-right direction, in which the first projecting portion 83 and the second projecting portion 85 are arrayed. The first projecting portion 83 and the second projecting portion 85 are arrayed on opposite sides of the first mounting portion 74.

As shown in FIG. 9, the vent plug 70 is provided with a second mounting portion 75 and a connecting portion 76. The second mounting portion 75 projects radially outward around the main body portion 711. A second support portion 347 shown in FIG. 15 supports the lower edge of the second mounting portion 75. The connecting portion 76 is provided to the rear of the second mounting portion 75. The connecting portion 76 is provided with a plurality of projecting portions 761 that project radially outward around the connecting portion 76. As shown in FIG. 6, the main body portion 711 is affixed to the liquid-holding bag 13 by thermally welding the sheets 13A and 13B, between which the connecting portion 76 is held, to the connecting portion 76.

Figure 12:
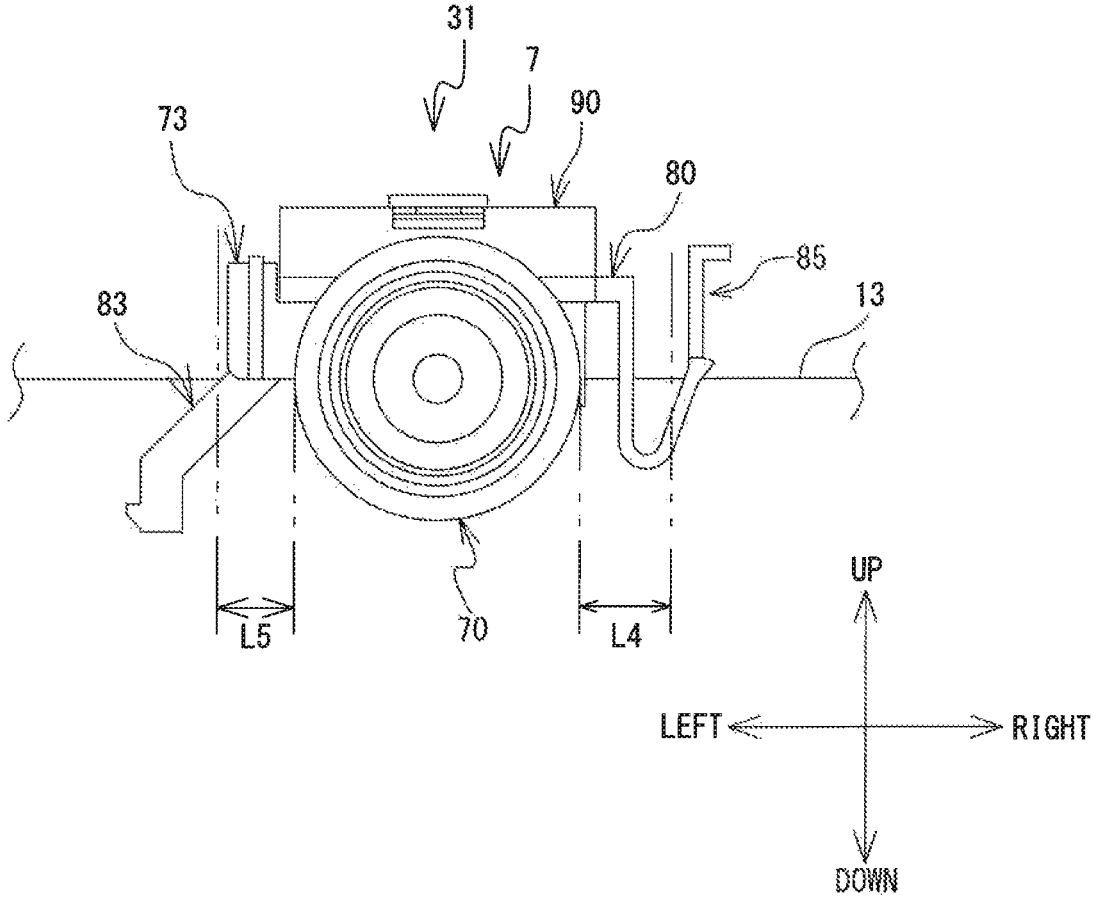
FIG. 12 is a front view of the vent plug unit in which the attaching portion is in a second orientation.
Figure 13:
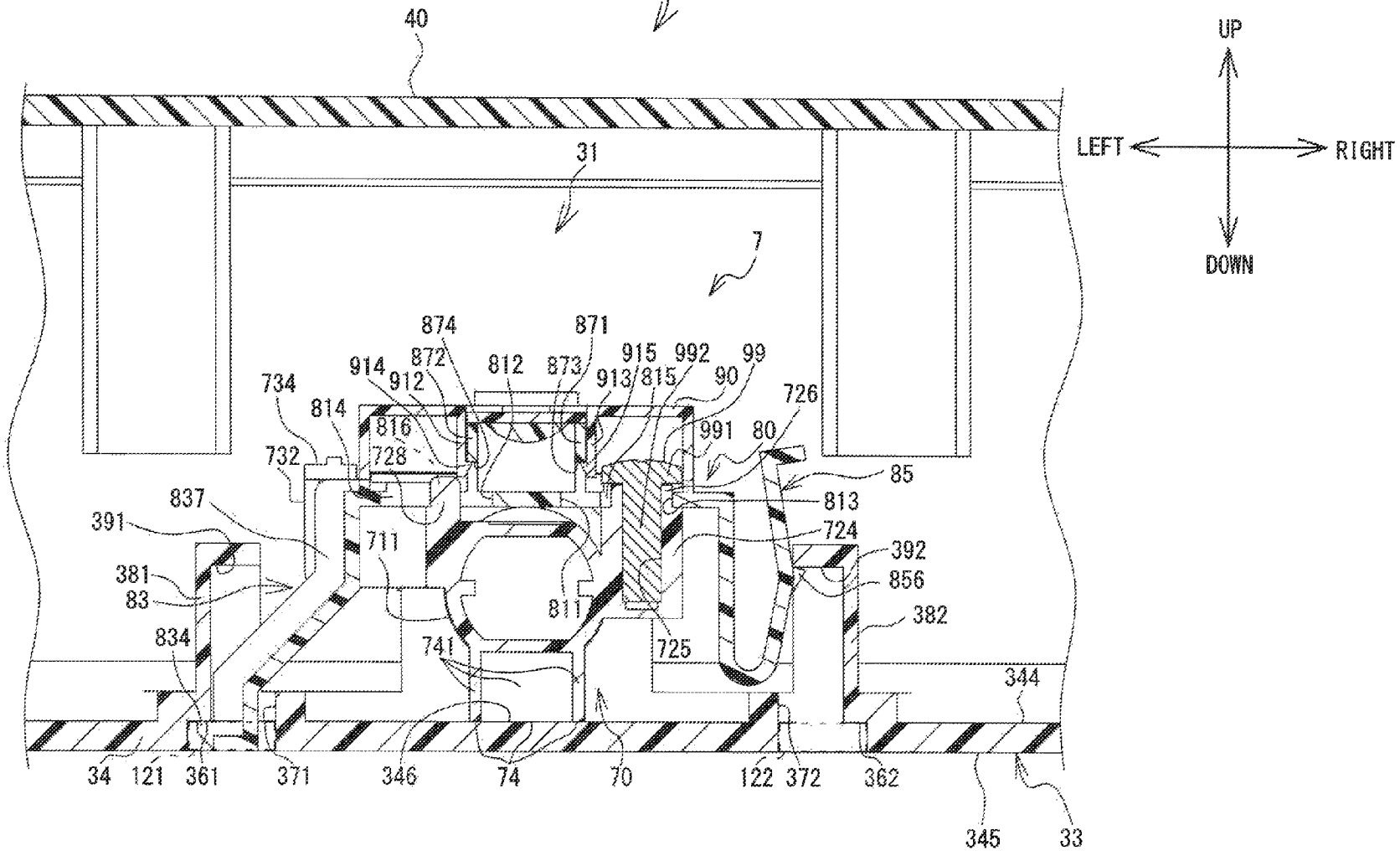
FIG. 13 is a vertical section view of the cartridge, including the vent plug unit in which the attaching portion is in the second orientation.

The attaching portion 80 will be explained. As shown in FIG. 9, the attaching portion 80 is a separate piece from the vent plug 70, and it is configured to be attached to the vent plug 70. The attaching portion 80 is provided with a base portion 81, the first projecting portion 83, the second projecting portion 85, and a wall portion 87. The attaching portion 80 is configured to be switched between a first orientation (refer to FIGS. 7 to 10) and a second orientation (refer to FIGS. 12 and 13). In the first orientation of the attaching portion 80 that is shown in FIGS. 7 to 10, the first projecting portion 83 is positioned to the right of the vent plug 70 and the second projecting portion 85 is positioned to the left of the vent plug 70. In the second orientation of the attaching portion 80 that is shown in FIGS. 12 and 13, the first projecting portion 83 is positioned to the left of the vent plug 70 and the second projecting portion 85 is positioned to the right of the vent plug 70. In other words, in the first orientation, the first projecting portion 83 is positioned to the right of the vent plug 70, which is a first direction side that is orthogonal to the axis X of the vent plug 70 and parallel to the faces of the sheets 13A and 13B of the liquid-holding bag 13 that does not contain the liquid. At the same time, the second projecting portion 85 is positioned on a second direction side in relation to the vent plug 70, the second direction being a direction opposite to the first direction. In the explanation that follows, the attaching portion 80 in the first orientation will be explained.

The base portion 81 is rectangular in a plan view, with its long axis extending from left to right, and it is a plate whose top face is recessed slightly downward. A pair of projecting portions 818 are provided in the front and rear of the base portion 81. Each one of the pair of the projecting portions 818 extends from left to right along the entire base portion 81 and projects upward. The pair of the projecting portions 818 position the holder 90.

The wall portion 87 encloses the center of the top face of the base portion 81 in a rectangular shape in a plan view, and it extends upward. Extending wall portions 871 and 872 are a pair of wall portions of the wall portion 87, on the left and right sides, respectively. An engagement opening 873 is provided in the lower edge of the extending wall portion 871. An engagement opening 874 is provided in the lower edge of the extending wall portion 872. Each of the engagement openings 873 and 874 is an opening that is rectangular in a side view. A pair of holder clips 914 and 915 engage with the engagement openings 873 and 874.

Rectangular holes 811 and 812 are provided in the base portion 81. The rectangular holes 811 and 812 are continuous with the engagement openings 873 and 874, respectively, and penetrate through the base portion 81 in the up-down direction. An engagement hole 813 is provided in the left of the base portion 81. An engagement hole 814 is provided in the right of the base portion 81. Each of the engagement holes 813 and 814 is a hole that is circular in a plan view and that penetrates through the base portion 81 in the up-down direction. A communicating portion 815 is provided between the rectangular hole 811 and the engagement hole 813. The communicating portion 815 penetrates through the base portion 81 in the up-down direction and links the rectangular hole 811 and the engagement hole 813 in the left-right direction. A communicating portion 816 shown in FIG. 10 penetrates through the base portion 81 in the up-down direction and links the rectangular hole 812 and the engagement hole 814 in the left-right direction.

The first projecting portion 83 is connected to the right edge of the base portion 81. The first projecting portion 83 is provided with a recessed portion 837. The right face of the recessed portion 837 is recessed toward the left. As shown in FIGS. 8 and 9, the first projecting portion 83 is provided with extension portions 831, 832, 833 and two first engaging nubs 834. The extension portion 831 extends downward from the right edge of the base portion 81. When the attaching portion 80 is mounted on the vent plug 70, the position of the lower edge of the extension portion 831 in the up-down direction is approximately the same as the position of the center of the main body portion 711 in a front view (refer to FIGS. 8 and 10).

As shown in FIG. 10, the extension portion 832 extends obliquely downward to the right from the lower edge of the extension portion 831. When the attaching portion 80 is mounted on the vent plug 70, the position of the lower edge of the extension portion 832 in the up-down direction is approximately the same as the position of the centers of the wall portions 741 in the up-down direction. The extension portion 833 extends downward from the lower edge of the extension portion 832. When the attaching portion 80 is mounted on the vent plug 70, the position of the lower edge of the extension portion 833 in the up-down direction is lower than the first mounting portion 74.

The two first engaging nubs 834 project to the right from the front and rear edges of the lower edge of the extension portion 833 (refer to FIGS. 8 to 10). The first engaging nubs 834 engage with the groove 362 in an outer face 345 of a supporting wall portion 34.

As shown in FIGS. 8 and 9, the second projecting portion 85 is connected to the left edge of the base portion 81. The second projecting portion 85 is a plate-shaped member that elastically deforms rightward toward the vent plug 70. The second projecting portion 85 extends downward, which is the projecting direction, then the lower end in the projecting direction bends and extends upward in the opposite direction from the projecting direction. The second projecting portion 85 is provided with extension portions 851, 852 and 853, a projecting portion 854, a bent portion 855, and two second engaging nubs 856. The extension portion 851 extends downward from the left edge of the base portion 81. The bent portion 855 is bent to the left in an arc shape from the lower end of the extension portion 851. The lower end of the bent portion 855 is a protruding end portion at the lower end of the second projecting portion 85. In other words, the second projecting portion 85 is bent to the left in a direction away from the first projecting portion 83 at the protruding end portion, and then extends toward the sheets 13A and 13B of the liquid-holding bag 13. The position of the lower end of the second projecting portion 85 in the up-down direction is approximately the same as the position of the upper edge of the extension portion 833 of the first projecting portion 83 (refer to FIGS. 8 and 10). The length of the second projecting portion 85 in the projecting direction is shorter than tire length of the first projecting portion 83 in the projecting direction. As shown in FIG. 8, a length L2 is shorter than a length L1. The length L2 is the distance in the up-down direction from the center of the tip portion 713 of the vent plug 70 in a front view to die lower end of the second projecting portion 85. The length L1 is the distance in the up-down direction from the center of the tip portion 713 of the vent plug 70 in a front view to the lower end of the first projecting portion 83.

The extension portion 852 extends obliquely upward to the left from the left edge of the bent portion 855. The position of the upper end of the extension portion 852 in the up-down direction is slightly higher than the center of the main body portion 711 in a front view. The extension portion 853 extends upward from the upper end of the extension portion 852. The position of the upper end of the extension portion 853 is slightly higher than the position of the center of the base portion 81 in the up-down direction. The projecting portion 854 projects to the left from the upper end of the extension portion 853.

As shown in FIG. 10, the two second engaging nubs 856 project to the left from the front and rear edges of the upper end of the extension portion 832. Each of the two second engaging nubs 856 engages with the inner side of the second opening 391 (refer to FIG. 10). As shown in FIG. 8, the vent plug 70 and the first mounting portion 74 are provided in an area that includes the center position between the first engaging nubs 834 and the second engaging nubs 856 in the left-right direction. Specifically, the vent plug 70 and the first mounting portion 74 are provided on a virtual line that extends in the up-down direction, midway between the first engaging nubs 834 and the second engaging nubs 856. Note that, in the direction in which the first projecting portion 83 and the second projecting portion 85 are arrayed, the distance front the center position between the first engaging nubs 834 and the second engaging nubs 856 to the first engaging nubs 834 is L3. The distance from the center position between the first engaging nubs 834 and the second engaging nubs 856 to the second engaging nubs 856 is also L3. The vent plug 70 is thus not easily tilted obliquely, so the liquid-holding bag 13 does not easily come out of the case 32.

As shown in FIG. 9, the screw 99 is provided with a head portion 991 and a shaft portion 992. The electric circuit board 98 is plate-shaped and rectangular in a plan view. Electronic parts 981 are mounted on the bottom face of the electric circuit board 98 (refer to FIG. 10). The electronic parts 981 may include a memory and the like (not shown in the drawings), for example. The memory stores the types and the like of the inks that are held in the liquid-holding container 31. A plurality of electrodes (not shown in the drawings) are provided on the top face of the electric circuit board 98.

Figure 11:
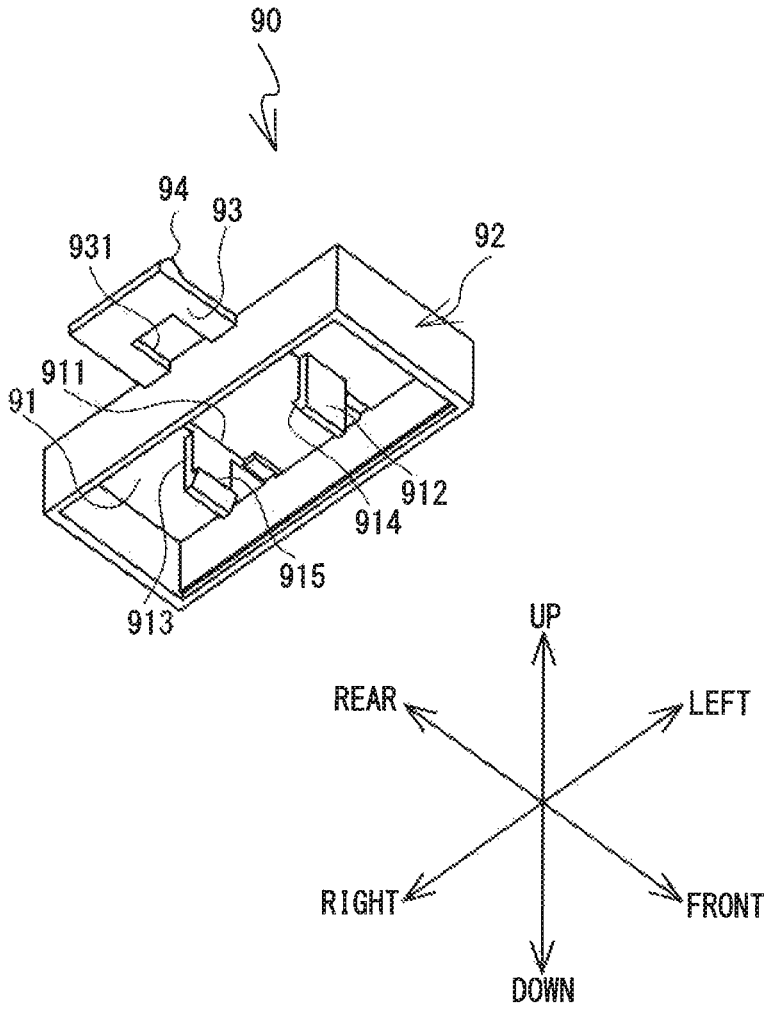
FIG. 11 is an oblique view of a holder.

The holder 90 will be explained. As shown in FIG. 7, the holder 90 holds the electric circuit board 98. The holder 90 is mounted on the top side of the attaching portion 80. As shown in FIGS. 9 and 11, the holder 90 is provided with a top wall portion 91, a perimeter wall portion 92, holder engaging portions 912 and 913, an extension portion 93, and a projecting portion 94. The top wall portion 91 is rectangular in a plan view, with its long axis extending from left to right, and it is the top face of the holder 90. A holder opening portion 931 is provided in the center of the top wall portion 91 in the left-right direction. The holder opening portion 911 is an opening that penetrates through the top wall portion 91 in the up-down direction. The holder opening portion 911 exposes the top face of the electric circuit hoard 98 to view (refer to FIG. 7).

The perimeter wall portion 92 is a wall portion that extends downward from the outer edges of the top wall portion 91. As shown in FIG. 11, the holder engaging portions 912 and 913 are engaging portions that extend downward, from the left and the right, edge, respectively, of the holder opening portion 911. The holder clip 914 is provided on the tip of the holder engaging portion 912. The holder clip 954 projects to the right. The holder clip 915 is provided on the tip of the holder engaging portion 913. The holder clip 915 projects to the left.

The extension portion 93 is a plate-shaped portion that extends rearward from the rear edge of the top wall portion 91. A through-hole 931 is provided in a central portion of the extension portion 93 in a plan view. The through-hole 931 is rectangular and penetrates through the extension portion 93. The extension portion 93, being provided with the through-hole 931, bends more easily than it would if it were not provided with the through-hole 931. The projecting portion 94 projects upward from the rear edge of the extension portion 93.

The ways in which the vent plug unit 7 is assembled will be explained. In the present embodiment, in a case where the liquid-holding bag 13 contains a color ink, an operator sets the attaching portion 80 in the first orientation. In a case where the liquid-holding bag 13 contains a white ink, the operator sets the attaching portion 80 in the second orientation. The assembling of the vent plug unit 7 may be performed at the factory where the liquid-holding container 31 is produced, for example.

The way in which the vent plug unit 7 is assembled in the case where the attaching portion 80 is set in the first orientation will be explained with reference to FIGS. 9 and 10. The operator places the attaching portion 80 on the support portion 72 of the vent plug 70. The flat portion 721 of the vent plug 70 supports the bottom face of the base portion 81. The upper end of the extension portion 851 of the second projecting portion 85 is positioned between the first arm portion 731 and the second arm portion 732 and below the wall portion 733 and the wall portion 734. The protruding portion 728 is inserted through the communicating portion 815. The tip portion 726 is inserted through the engagement hole 814 of the base portion 81. The operator screws the screw 99 into the thread groove 725 from the top side of the base portion 81. The base portion 81 is affixed to the support portion 72 by sandwiching the base portion 81 between the cylindrical portion 724 and the head portion 991 of the screw 99.

The operator positions the electric circuit board 98 underneath the holder opening portion 911 of the holder 90. The electric circuit hoard 98 is held between the holder engaging portion 912 and the holder engaging portion 913 (refer to FIG. 11). The operator places the holder 90, which holds the electric circuit board 98, on the top side of the base portion 81. As shown in FIG. 10, the holder engaging portion 912 is disposed on the left side of the extending wall portion 871 of the attaching portion 80. The holder clip 914 engages with the engagement opening 873. The holder engaging portion 913 is disposed on the right side of the extending wall portion 872 of the attaching portion 80. The holder clip 915 engages with the engagement opening 874. The electric circuit board 98 is sandwiched between the bottom face of the top wad portion 91 and the upper edge of the wall portion 87 (refer to FIG. 9).

The way in which the vent plug unit 7 is assembled in the case where the attaching portion 80 is set in the second orientation will be explained. As shown in FIGS. 9, 12 and 13, in the case where the attaching portion 80 is set in the second orientation, the operator attaches die attaching portion 80 to the vent plug 70 with the left and right sides of the attaching portion 80 reversed. The operator places the attaching portion 80 on the support portion 72 of the vent plug 70. The flat portion 721 of the vent plug 70 supports the bottom face of the base portion 81. The upper end of the extension portion 831 of the first projecting portion 83 is positioned between the first arm portion 731 and the second arm portion 732 and below the wall portion 733 and the wall portion 734. The protruding portion 728 is inserted through the communicating portion 816. The tip portion 726 is inserted through the engagement hole 813 of the base portion 81. The operator screws the screw 99 into the thread groove 725 from the top side of the base portion 81. The base portion 81 is affixed to the support portion 72 by sandwiching the base portion 81 between the cylindrical portion 724 and the head portion 991 of the screw 99. The attaching portion 80 is disposed on the support portion 72 of the vent plug 70 as described above.

In the same manner as when the attaching portion 80 is set in the first orientation, the operator places the holder 90, which holds the electric circuit board 98, on the top side of the base portion 81. As shown in FIG. 13, the holder engaging portion 912 is disposed on the left side of the extending wall portion 872 of the attaching portion 80. The holder clip 914 engages with the engagement opening 874. The holder engaging portion 913 is disposed on the right side of the extending wall portion 871 of the attaching portion 80. The holder clip 915 engages with the engagement opening 873.

The case 32 will be explained. As shown in FIGS. 4 and 5, the case 32 includes a first case 33 and a second case 40. The first case 33 supports the liquid-holding container 31. The second case 40 is disposed on the top side of the first case 33 and is configured to be mounted on and removed from the first case 33.

Figure 14:
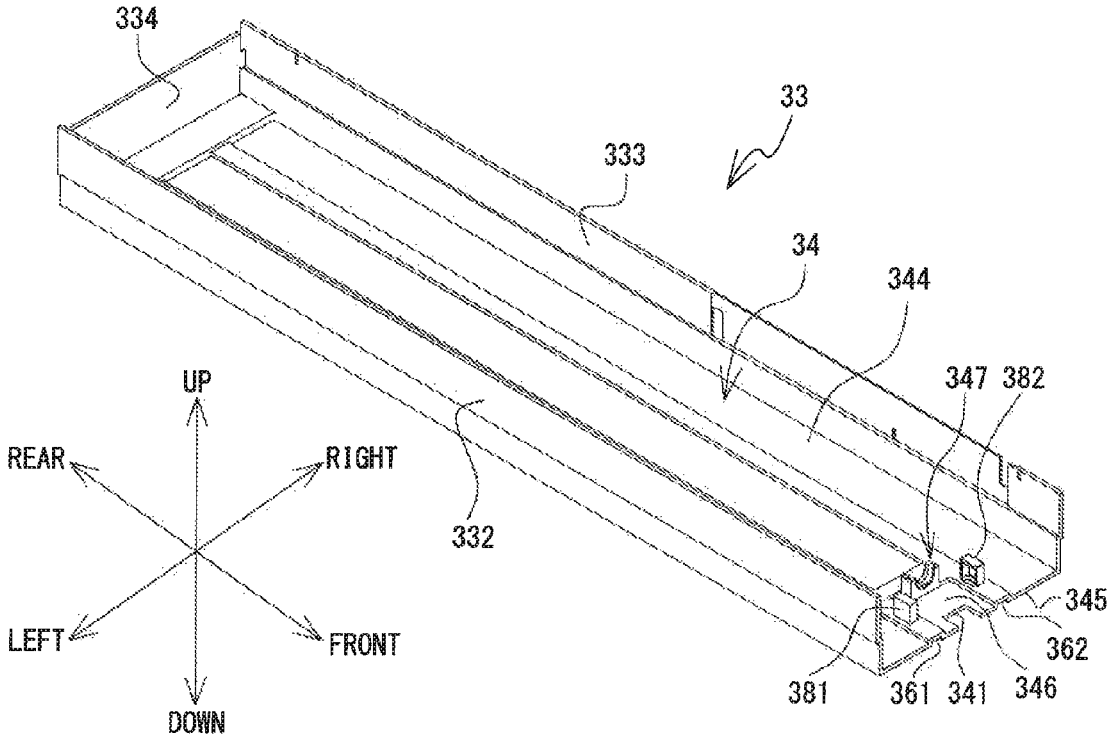
FIG. 14 is an oblique view of a first case.

The first case 33 will be explained. As shown in FIG. 14, the first case 33 is provided with the supporting wall portion 34, a left wall portion 332, a right wall portion 333, and a rear wall portion 334. The supporting wall portion 34 is a wall portion that is rectangular in a plan view and supports the liquid-holding container 31, and it extends in the front-rear direction, which is the X axis direction. The left wall portion 332, the right wall portion 333, and the rear wall portion 334 extend upward from the left edge, the right edge, and the rear edge, respectively, of the supporting wall portion 34. The front end of the first case 33 is not provided with a wall portion and is open.

A notch 341 is provided in the center in the left-right direction of the front edge of the supporting wall portion 34. The notch 341 is rectangular in a plan view and is recessed toward the rear. An inner face 344 is the face of the supporting wall portion 34 on the side of the supporting wall portion 34 where the liquid-holding container 31 is placed. The outer face 345 is the face of the supporting wall portion 34 on the opposite side from the inner face 344. The grooves 361 and 362 are provided hi the outer face 345. Each of the grooves 361 and 362 is recessed upward, which is the direction from the supporting wall portion 34 toward the liquid-holding container 31, and extends in the X axis direction. The groove 361 is provided to the left of the notch 341 and extends in the front-rear direction of the supporting wall portion 34. The groove 362 is provided to the right of the notch 341 and extends in the front-rear direction of the supporting wall portion 34. As a result of providing the grooves 361 and 362 in the outer face 345, the top sides of the grooves 361 and 362 protrude upward from the inner face 344.

Figure 15:
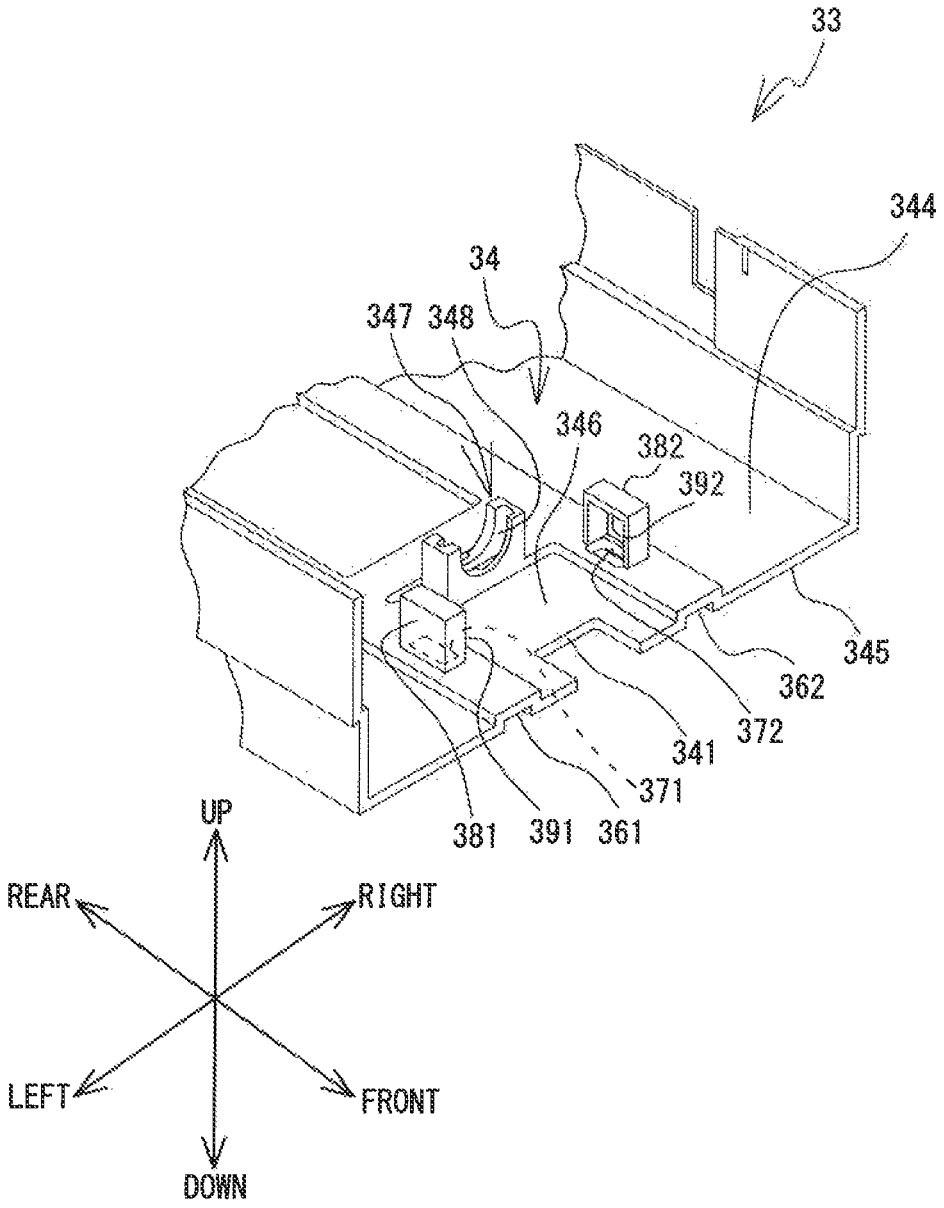
FIG. 15 is an enlarged view of the main part of the first case.

As shown in FIGS. 10 and 15, a first opening 371 and the first opening 372 are respectively provided in the front portion of the grooves 361 and 362, which is one end of the grooves 361, 362 in the X axis direction. The first openings 371 and 372 are rectangular openings in a plan view that penetrate through the supporting wall portion 34 in the up-down direction. The first opening 372 is provided in a position that corresponds to the first projecting portion 83 and that is closer to the first projecting portion 83 than the second projecting portion 85 of the attaching portion 80 in the first orientation (refer to FIG. 10). The first opening 371 is provided in a position where the first projecting portion 83 of the attaching portion 80 in the second orientation can protrude from the first opening 371 (refer to FIG. 13). In a case where the liquid-holding container 31 is mounted in the first case 33, the first projecting portion 83 protrudes from one of the first opening 371 and the first opening 372 (refer to FIGS. 10 and 13).

As shown in FIG. 15, opening wall, portions 383 and 382 form box shapes above the grooves 361 and 362 such that the feces of the opening wall portions 381 and 382 that face each other are open. The second opening 391 is provided on the right face side of the opening wall portion 381 (refer to FIGS. 10 and 15). The first opening 371 and the second opening 391 are continuous with one another inside the opening wall portion 381. A second opening 392 is provided on the left face side of the opening wall portion 382. The first opening 372 and the second opening 392 are continuous with one another inside the opening wall portion 382. The first openings 371 and 372 are respectively located inside the opening wall portions 381 and 382 (refer to FIGS. 10 and 15). The second opening 391 is open in the direction that intersects the inner face 344 that is parallel to the opening face of the first opening 371. The second opening 392 is open in the direction that intersects the inner face 344 that is parallel to the opening face of the first opening 372. Each of the opening faces of the second openings 391 and 392 is parallel to the left wall portion 332 and the right wall portion 333. The opening wall portion 381 is provided in a position that engages with the second projecting portion 85 of the attaching portion 80 in the first orientation (refer to FIG. 10). The opening wall portion 382 is provided in a position that engages with the second projecting portion 85 of the attaching portion 80 in the second orientation (refer to FIG. 13).

A first support portion 346 is provided to the rear of the notch 341 in the supporting wall portion 34, between the groove 361 and the groove 362 in the left-right direction. The first support portion 346 is a flat surface that supports the first mounting portion 74 of the vent plug unit 7 (refer to FIGS. 10 and 13). The second support portion 347 is provided on the rear side of the first support portion 346. The second support portion 347 supports the second mounting portion 75 of the vent plug 70. The second support portion 347 is a wall portion that is longer in the left-right direction and extends upward from the supporting wall portion 34, and its upper edge is recessed into a U shape in a front view. A recessed portion 348 is provided in the central part of the front-rear direction of the second support portion 347. The recessed portion 348 is recessed downward in a semi-circular shape. The lower edge of the second mounting portion 75 of the vent plug 70 is disposed in the recessed portion 348. The second support portion 347 thus supports the vent plug 70 (refer to FIG. 16).

The second case 40 will be explained. As shown in FIG. 4, the second case 40 is provided with, a top wall portion 401, a left wall portion 402, and a right wall portion 403. The top wall portion 401 is positioned opposite the supporting wall portion 34 in the up-down direction and extends in the front-rear direction, which is the X axis direction. The left wall portion 402 and the right wall portion 403 extend downward from the left and the right edges, respectively, of the top wall portion 401. The front and the rear ends of the second case 40 are not provided with wall portions and are open. In a case where the second case 40 is mounted on the first case 33, the left wall portion 402 and the right wall portion 403 are respectively positioned on the outer side of the left wall portion 332 and the outer side of the right wall portion 333.

The way in which the operator mounts the liquid-holding container 31 in the case 32 and then mounts the liquid-holding container 31 in the cartridge mounting portion 8 will be explained. For example, the operator may mount the liquid-holding container 31 in the case 32 at the factory that produces the cartridge 3, as well as at a factory or home where the printer 1 is used. At a factory or home where the printer 1 is used, for example, the operator removes the used liquid-holding container 31 from the cartridge 3, then mounts a new liquid-holding container 31 in the case 32.

A case in which the liquid-holding container 31 is mounted in the cartridge 3 while the attaching portion 80 is in the first orientation will be explained. The operator grasps the vent plug unit 7 of the liquid-holding container 31. The operator uses a finger to press the left face of the projecting portion 854 of the second projecting portion 85 toward the right. The second projecting portion 85 deforms elastically toward the vent plug 70. The operator places the liquid-holding container 31 into the first case 33 from above the first case 33. As shown in FIG. 10, the first projecting portion 83 protrudes downward from the first opening 372. The lower end of the first projecting portion 83 enters the groove 362. The first engaging nubs 834 of the first projecting portion 83 engage with the outer face 345 side of the groove 362. The second engaging nubs 856 of the second projecting portion 85 engage with the second opening 391. The second projecting portion 85 engages with the second opening 391 in the elastically deformed state. The liquid-holding container 31 is thus disposed in the first case 33.

The first support portion 346 and the second support portion 34 support the first mounting portion 74 and the second mounting portion 75, respectively. The operator can therefore engage the first projecting portion 83 and the second projecting portion 85 with the first case 33 while pressing the vent plug unit 7 downward. The operator may dispose the liquid-holding container 31 in the first case 33 more easily than in a case where at least one of the first mounting portion 74 and the second mounting portion 75 is not supported.

In a case where the attaching portion 80 is in the second orientation (refer to FIG. 12), the left-right positional relationship of the first projecting portion 83 and the second projecting portion 85 is the reverse of the state that is shown in FIG. 10. As shown in FIG. 13, the first projecting portion 83 protrudes downward from the first opening 371. The lower end of the first projecting portion 83 enters the groove 361. The first engaging nubs 834 of the first projecting portion 83 engage with the outer face 345 side of the groove 361. The second engaging nubs 856 of the second projecting portion 85 engage with the bottom face of the upper wall of the second opening 392. The second projecting portion 85 engages with the second opening 392 in the elastically deformed state. The operator is therefore able to mount the liquid-holding container 31 in a single type of the first case 33, regardless of whether the attaching portion 80 is in the first orientation or the second orientation.

After placing the liquid-holding container 31 in the first case 33, the operator places the second case 40 on the top side of the first case 33. The cartridge 3 is thus complete. The operator mounts the completed cartridge 3 in the cartridge mounting portion 8. The operator orients the front end of the cartridge 3 toward the cartridge mounting portion 8 and inserts the cartridge 3 into one of the openings 120A to 120F (refer to FIG. 3).

As shown in FIG. 10, in a case where the liquid inside the liquid-holding bag 13 is a color ink, the attaching portion 80 is in the first orientation. The first projecting portion 83 protrudes into the groove 362 from the first opening 372 in the first case 33. The second projecting portion 85 is not present in the groove 361.

As shown in FIG. 3, the openings 120A to 120D constitute the area in which the color inks are disposed. Therefore, in a case where the operator inserts the cartridge 3 into one of the openings 120A to 120D, the protuberance 121 enters the groove 361. The cartridge 3 that is positioned by the protuberance 121 may enter the cartridge mounting portion 8 smoothly. In FIG. 10, the protuberance 121 inside the groove 361 is indicated by a dotted line. The openings 120E and 120F constitute the area in which the white inks are disposed. In a case where the operator tries to insert a color ink cartridge 3 into one of the openings 120E, 120F, the protuberance 122 comes into contact with the first projecting portion 83, which is inside the groove 362. The operator is therefore unable to insert the color ink cartridge 3 into the openings 120E and 120F. The operator may be restricted, from mounting a color ink cartridge 3 in the wrong part of the cartridge mounting portion 8. In FIG. 10, the protuberance 122 that comes into contact with the first, projecting portion 83 inside the groove 362 is indicated by a dotted line.

For example, a case may occur in which, instead of a white ink liquid-holding container 31, the operator mounts a color ink liquid-holding container 31 in the case 32 by mistake. In that case, the attaching portion 80 is in the first orientation. The first projecting portion 83 protrudes from the first opening 372. In a case where the operator inserts the cartridge 3 into one of the openings 120E and 120F, the protuberance 122 comes into contact with the first projecting portion 83, which is inside the groove 362. Because the cartridge 3 cannot be inserted into the openings 120E and 120F, the operator notices that the wrong type of the liquid-holding container 31 is mounted in the case 32. The operator may thus be restricted from mounting the wrong type of the liquid-holding container 31 in the case 32.

As shown in FIG. 13, in a case where liquid inside the liquid-holding bag 13 is a white ink, the attaching portion 80 is in the second orientation. The first projecting portion 83 protrudes into the groove 361 from the first opening 371 in the first case 33. The first projecting portion 83 is not present in the groove 362. Therefore, in a case where the operator inserts the cartridge 3 into one of the openings 120E and 120F, the protuberance 122 enters the groove 362. The cartridge 3 that is positioned by the protuberance 122 may be inserted into the cartridge mounting portion 8 smoothly. In FIG. 13, the protuberance 122 that is inside the groove 362 is indicated by a dotted line.

In a case where the operator tries to insert a white ink cartridge 3 into one of the openings 120A to 120D, the protuberance 121 comes into contact with the first projecting portion 83, which is inside the groove 361. Therefore, the operator cannot insert the white ink cartridge 3 into any of the openings 120A to 120D. The operator may be restricted from mounting a white ink cartridge 3 in the wrong part of the cartridge mounting portion 8. In FIG. 13, the protuberance 121 that comes into contact with the first projecting portion 83 inside the groove 361 is indicated by a dotted line.

For example, a case may occur in which, instead of a color ink liquid-holding container 31, the operator mounts a white ink liquid-holding container 31 in the case 32 by mistake. In that case, the attaching portion 80 is in the second orientation. The first projecting portion 83 protrudes from the first opening 371. In a case where the operator tries to insert the cartridge 3 into one of the openings 120A to 120D, the protuberance 121 comes into contact with the first projecting portion 83, which is inside the groove 361. Because the cartridge 3 cannot be inserted into the openings 120A to 120D, the operator notices mat the wrong type of the liquid-holding container 31 is mounted in the case 32. The operator may thus be restricted from mounting the wrong type of the liquid-holding container 31 in the case 32.

Figure 16:
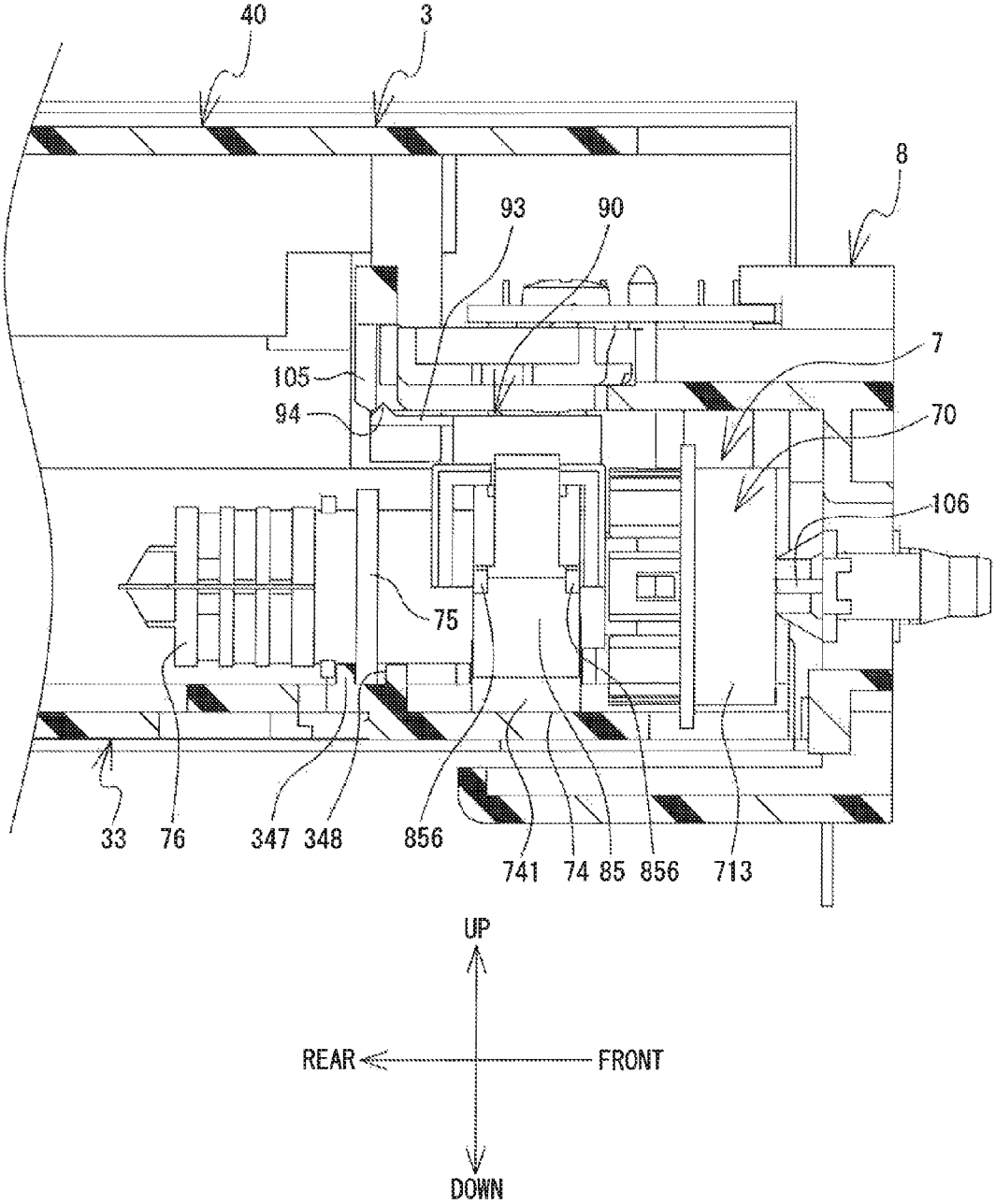
FIG. 16 is a figure that shows an area around a vent plug of the cartridge that is mounted in the cartridge mounting portion.

As shown in FIG. 16, when the cartridge 3 is mounted in the cartridge mounting portion 8, an engaging portion 105 that engages with the projecting portion 94 in the cartridge mounting portion 8 is inserted into the interior of the cartridge 3 through an opening in the front end of the cartridge 3. The engaging portion 105 engages with the projecting portion 94 of the holder 90. The engaging portion 105 that is engaged with the projecting portion 94 restricts the movement of the cartridge 3 toward the rear inside the cartridge mounting portion 8. In the process of the projecting portion 94 engaging with the engaging portion 105, the extension portion 93 is bent downward below the engaging portion 105. The projecting portion 94 engages with the engaging portion 105 smoothly.

A plurality of electrodes (not shown in the drawings) that are provided in the cartridge mounting portion 8 come into contact with the plurality of the electrodes (not shown in the drawings) on the top face of the electric circuit board 98 that is exposed by the holder opening portion 911 as shown in FIG. 7. A CPU (not shown in the drawings) of the printer 1 is electrically connected to the electronic parts 981 shown in FIG. 10. The CPU of the printer 1 is therefore able to specify the type of the ink, for example. The hollow needle 106 that draws the liquid out of the liquid-holding container 31 pierces the rubber plug (not shown in the drawings) that is disposed inside the hollow portion 712 of the liquid-holding container 31. The hollow needle 106 has a hole through which the ink flows. The ink inside the liquid-holding bag 13 is supplied to the head portion (not shown in the drawings) through the hollow needle 106.

As explained above, the liquid-holding container 31 and the cartridge 3 of the present embodiment are provided with the first projecting portion 83 and the second projecting portion 85 on opposite sides of the vent plug 70. The length of the second projecting portion 85 is shorter than that of the first projecting portion 83 (refer to FIGS. 8 and 12). Therefore, by checking the positional relationship of the first projecting portion 83 and the second projecting portion 85, whose lengths are different, with the vent plug 70 in the center, the operator may determine which of the two types of liquids is contained in the liquid-holding bag 13.

In the present embodiment, in the case where the first projecting portion 83 is on the right side of the vent plug 70 and the second projecting portion 85 is on the left side of the vent plug 70, the liquid-holding bag 13 contains a color ink (refer to FIG. 8). In the case where the second projecting portion 85 is on the right side of the vent plug 70 and the first projecting portion 83 is on the left side of the vent plug 70, the liquid-holding bag 13 contains a white ink (refer to FIG. 12). Therefore, if the protruding portion on the left side of the vent ping 70 is shorter than the protruding portion on the right side, the operator may determine that the liquid-holding bag 13 contains a color ink. If the protruding portion on the right side of the vent plug 70 is shorter than the protruding portion on the left side, the operator may determine that the liquid-holding bag 13 contains a white ink. Furthermore, varying the differences in length between the first projecting portion 83 and the second projecting portion 85 makes it possible for the operator to distinguish among a plurality of types of liquids.

When mounting the liquid-holding container 31 in the first case 33, the operator grasps the vent plug 70 and engages the first projecting portion 83 and the second projecting portion 85 with the first case 33. In the present embodiment, the operator may easily determine the type of the ink by checking the vent plug 70 that he is grasping. Therefore, the liquid-holding bag 13 does not require a label that indicates the type of the ink. Even in a case where a label that indicates the type of the ink is provided on the liquid-holding bag 13, it is acceptable for the operator not to cheek the label. The operator may easily perform the series of operations of grasping the vent plug 70 of the liquid-holding container 31, checking the type of the ink, and mounting the liquid-holding container 31 in the first case 33.

The first projecting portion 83 and the second projecting portion 85 are components by which the types of the inks may be distinguished and are components that engage with the first case 33. Therefore, the costs of the liquid-holding container 31 and the cartridge 3 may be reduced from what they would be in a case where the components by which the types of the inks may be distinguished and the components that engage with the first case 33 are provided separately.

The second projecting portion 85 bends at an edge in a direction (in the present embodiment, the downward direction) that intersects the X axis direction, then extends in the opposite direction, which is upward. The operator may recognize the second projecting portion 85 more easily than would be possible if the second projecting portion 85 were simply a wall portion that extends in a straight line in the direction that intersects the X axis direction. Therefore, the operator may easily determine which of the two types of liquids is contained in the liquid-holding bag 13.

The first mounting portion 74 is a flat portion that extends in the left-right direction, in which the first projecting portion 83 and the second projecting portion 85 are disposed opposite one another (refer to FIG. 7). The operator is able to check the lengths of the first projecting portion 83 and the second projecting portion 85 by using as a reference the position in the up-down direction of the first mounting portion 74, which extends in the left-right direction. The operator may check the difference in the lengths of the first projecting portion 83 and the second projecting portion 85 more easily than would be possible in a case where the first mounting portion 74 is not provided. The operator is therefore easily able to determine the type of the liquid.

The first mounting portion 74, which is a flat portion, is configured to support the vent plug 70. When the liquid-holding container 31 is mounted in the first case 33 of the cartridge 3, the first case 33 supports the first mounting portion 74. The orientation of the liquid-holding container 31 is stable. Even in the state in which the first mounting portion 74 is supported by the first case 33, the operator may easily cheek the difference in the lengths of the first projecting portion 83 and the second projecting portion 85. Therefore, the operator may easily determine the type of the liquid.

The attaching portion 80 is provided with the engagement holes 813 and 814 that engage with the vent plug 70 in the first orientation and the second orientation. Using the single type of the attaching portion 80, the operator may switch the positional relationships of the first projecting portion 83 and the second projecting portion 85 with respect to the vent plug 70 by switching the orientation of the attaching portion 80 between the first orientation and the second orientation. The two types of the liquid-holding container 31 that enable the types of the liquids to be determined may therefore be manufactured easily. If the first projecting portion 83 and the second projecting portion 85 were to be formed as a single unit with the vent plug 70, two types of the vent plug 70 would be required, with the positions of the first projecting portion 83 and the second projecting portion 85 switched. The costs of the liquid-holding container 31 and the cartridge 3 may be reduced from what, they would be in that case.

As shown in FIG. 8, the distance in the left-right direction between the center of the first projecting portion 83 in the first orientation and the right edge of the vent plug 70 is defined as a first distance L4. The distance in the left-right direction between the center of the second projecting portion 85 in the first orientation and the left edge of the vent plug 70 is defined as a second distance L5. As shown in FIG. 12, in a case where the attaching portion 80 is in the second orientation, the area in which the first projecting portion 83 extends in the left-right direction includes a position where the distance from the vent plug 70 is the second distance L5. The area in which, the second projecting portion 85 extends in the left-right direction includes a position where the distance from the vent plug 70 is the first distance L4.

In the left-right direction, in which the first projecting portion 83 and the second projecting portion 85 are disposed opposite one another, the positional relationships of the first projecting portion 83 and the second projecting portion 85 with, respect to the vent plug 70 are substantially the same, even if the attaching portion 80 is switched between the first orientation and the second orientation. Therefore, without considering the positional relationships of the first projecting portion 83 and the second projecting portion 85 with respect to the vent plug 70 in the left-right direction, the operator may recognize that the lengths of the first projecting portion 83 and the second projecting portion 85 in the projecting direction are different. The operator may easily determine that the lengths of the first projecting portion 83 and the second projecting portion 85 are different. The operator may easily determine the type of the ink that is contained in the liquid-holding container 31.

The first projecting portion 83 protrudes from any one of the first openings 371 and 372 (refer to FIGS. 10 and 13). For example, in the case where the attaching portion 80 is in the first orientation, as shown in FIG. 10, the first projecting portion 83 protrudes from the first opening 372 in the right side of the first case 33. From the outer side of the first case 33, the operator may visually check the first projecting portion 83 that protrudes from the first opening 372. The operator may confirm that the cartridge 3 is one inside of which is disposed the liquid-holding container 33 that is filled with a color ink.

In the case where the attaching portion 80 is in the second orientation, as shown in FIG. 13, the first projecting portion 83 protrudes from the first opening 371 in the left side of the first case 33. From the outer side of the first case 33, the operator may visually check the first projecting portion 83 that protrudes from the first opening 371. The operator may confirm that the cartridge 3 is one inside of which is disposed the liquid-holding container 31 that is filled with a white ink. Therefore, by checking the position of the first projecting portion 83 that protrudes from the first case 33, the operator may determine the type of the ink that is contained in the liquid-holding bag 13. It is not necessary for the operator to remove the second case 40 from the first case 33 in order to check the type of the ink.

As shown in FIGS. 10 and 13, the first projecting portion 83 and the first engaging nubs 834 that protrudes from any one of the first openings 371 and 372 are disposed in any one of the grooves 361 and 362. The first projecting portion 83 and the first engaging nubs 834 do not protrude below the bottom edge of the supporting wall portion 34. In a case where the cartridge 3 is placed on a flat surface such as a desk or the like, the first projecting portion 83 and the first engaging nubs 834 do not come into contact with the flat surface. Damage to the first projecting portion 83 and the first engaging nubs 834 may therefore be inhibited. A case in which it is difficult to determine the type of the ink that is contained in the liquid-holding bag 13 may be prevented. Inhibiting damage to the first engaging nubs 834 means that it is difficult for the engagement between the first engaging nubs 834 and the first case 33 to be broken. A case in which the liquid-holding container 31 comes out of the first case 33 may therefore be prevented. Because the first projecting portion 83 and the first engaging nubs 834 do not come into contact with the flat surface, a case in which the orientation of the cartridge 3 becomes unstable may be prevented.

The second projecting portion 85 engages with any one of the second openings 391 and 392. The liquid-holding container 31 is more resistant to coming out of the first case 33 than it would be if the second projecting portion 85 did not engage with any one of the second openings 391 and 392. The second projecting portion 85 is plate-shaped and extends downward, which is a direction that is orthogonal to the X axis direction, bends at its lower edge, and then extends in the opposite direction. The second projecting portion 85 is elastically deformable. The second projecting portion 85 may be engaged with any one of the second openings 391 and 392 by elastic force. The liquid-holding container 31 is more resistant to coming out of the first case 33 than it would be if the second projecting portion 85 did not deform elastically. The first projecting portion 83 reliably protrudes from any one of the first openings 371 and 372. A case in which it is difficult to determine the type of the liquid may therefore be prevented.

The first projecting portion 83 and the second projecting portion 85 respectively include the first engaging nubs 834 and the second engaging nubs 856. The liquid-holding container 31 is more resistant to coming out of the first case 33 than it would be if the first engaging nubs 834 and the second engaging nubs 856 were not provided. The first projecting portion 83 reliably protrudes from any one of the first openings 371 and 372. A case in which it is difficult to determine the type of the ink that is contained in the liquid-holding bag 13 may therefore be prevented.

As shown in FIG. 10, the vent plug 70 and the first mounting portion 74 are provided in the area that include a position that is at the midpoint between the first engaging nubs 834 and the second engaging nubs 856. The forces that hold the vent plug 70 in place by acting on the first engaging nubs 834 and the second engaging nubs 856 are distributed more uniformly than would be the case if one of the vent plug 70 and the first mounting portion 74 were not provided in an area that includes a position that is at the midpoint between the first engaging nubs 834 and the second engaging nubs 856. Because the vent plug 70 is resistant to being tilted obliquely, a case in which the first engaging nubs 834 disengage from the first case 33 and the second engaging nubs 856 disengage from the first case 33 may be suppressed. Therefore, a case in which the liquid-holding container 31 comes out of the first case 33 may be prevented. The first projecting portion 83 reliably protrudes from any one of the first openings 371 and 372. A case in which it is difficult to determine the type of the ink may therefore be prevented.

The first openings 371 and 372 are provided in positions that correspond to the first projecting portion 83 of the attaching portion 80 in the second orientation and the first orientation, respectively. The opening wall portions 381 and 382 are provided in positions that correspond to the second projecting portion 85 of the attaching portion 80 in the first orientation and the second orientation, respectively. The positional relationships of the first projecting portion 83 and the second projecting portion 85 with respect to the vent ping 70 are switched by switching the single type of the attaching portion 80, which engages with the vent plug 70, between the first orientation and the second orientation. The vent plug 70 can therefore be mounted in the first case 33. The first projecting portion 83 protrudes from one of the first openings 371 and 372 regardless of whether the attaching portion 80 is in the first orientation or the second orientation. Therefore, the operate may determine the type of the ink by checking the first projecting portion 83 that protrudes from one of the first openings 371 and 372.

The first projecting portion 83 and the second projecting portion 85 engage with the first case 33 in positions on opposite sides of the vent plug 70. The engagement between the vent plug 70 and the first case 33 is more resistant to disengaging than would be the case if only one projecting portion projected from the vent plug 70 and engaged with an engagement hole in the first case 33, for example. The second projecting portion 85 is engaged with any one of the second openings 391 and 392 by elastic force. The vent plug 70 is more resistant to being displaced in the left-right direction, in which the second projecting portion 85, the vent plug 70, and the first projecting portion 83 are arrayed, than would be the case if the second projecting portion 85 engaged with any one of the second openings 391 and 392 in a state in which it was not elastically deformed. The engagements between the first projecting portion 83 and any one of the first openings 371 and 372 are resistant to disengaging. The engagements between the second projecting portion 85 and any one of the second openings 391 and 392 are resistant to disengaging.

Therefore, a case in which the liquid-holding container 31 comes out of the first case 33 may be prevented.

The first engaging nubs 834 engage with the outer face 345 of the supporting wall portion 34. The vent plug 70 is more resistant to moving upward, which is the direction away from the supporting wall portion 34, than would be the case if the first engaging nubs 834 were not provided. The engagements between the first engaging nubs 834 and any one of the first openings 371 and 372 are resistant to disengaging. Therefore, a case in which the vent plug 70 floats up from the supporting wall portion 34 may be prevented. The second engaging nubs 856 engage with any one of the opening wall portions 381 and 382. The engagements between the second projecting portion 85 and any one of the opening wall portions 381 and 382 are more resistant to disengaging than would be the case if the second engaging nubs 856 were not provided. Therefore, a case in which the liquid-holding container 31 comes out of the first case 33 may be prevented.

The vent plug unit 7 is provided with the first mounting portion 74 and the second mounting portion 75. The vent plug 70 is supported by the first support portion 346 and the second support portion 347 of the supporting wall portion 34. The orientation of the vent plug 70 is more stable than would be the case if the vent plug 70 were supported at only one location. The engagements between the first engaging nubs 834 and the first case 33 are resistant to disengaging. The engagements between the second engaging nubs 856 and the first case 33 are resistant to disengaging. Therefore, a case in which the liquid-holding container 31 comes out of the first case 33 may be prevented.

The attaching portion 80 is a separate unit from the vent plug 70. Therefore, the attaching portion 80 is not limited to being attached to the vent plug 70 of the present embodiment, and it may be easily attached to various types of vent plugs. For example, the operator may remove the attaching portion 80 from the vent plug 70 of a liquid-holding container 31 that has been used and reuse it as the attaching portion 80 for the new liquid-holding container 31. Therefore, the attaching portion 80 may easily be given a structure that prevents the case in which the liquid-holding container 31 from coming out of the case 32.

As described above, the liquid-holding container 31 according to the present embodiment is resistant to coming out of the first case 33. Therefore, the operator may check the position of the first projecting portion 83 from the outer side of the first case 33. The operator may reliably determine the type of the ink that is contained in the liquid-holding bag 13.

The holder 90, which holds the electric circuit board 98, is disposed on the top side of the attaching portion 80, which is the opposite side from the projecting direction. The operator may mount the liquid-holding container 31 that holds the electric circuit board 98 reliably in the first case 33. The holder clips 914 and 915, which are provided on the holder engaging portions 912 and 913, engage with the engagement openings 873 and 874 that are provided in the extending wall portions 871 and 872. The liquid-holding container 31 may hold the electric circuit board 98 more reliably than would be the case if the holder clips 914 and 915 were not engaged with the engagement openings 873 and 874.

The holder 90 is provided with the extension portion 93, which extends toward the rear, and the projecting portion 94, which projects upward from the extension portion 93. The operator may recognize the orientation of the holder 90 more easily than would be the case if the extension portion 93 and the projecting portion 94 were not provided. In a case where the operator attaches the holder 90 to the attaching portion 80, a case in which the holder 90 is disposed in the wrong orientation may be prevented. Because the electric circuit board 98 thus is disposed in the correct orientation, the electronic parts 981 may be electrically connected to the CPU of the printer 1 reliably.

The present disclosure is not limited to the embodiment that is described above, and various types of modifications can be made. The liquid whose type the operator determines by checking the first projecting portion 83 and the second projecting portion 85 is not limited to an ink. For example, by using the first projecting portion 83 and the second projecting portion 85, the operator may also distinguish between an ink and a discharge agent that removes the color from a dyed fabric. In that case, in the liquid-holding container 31 that contains the discharge agent, the first projecting portion 83 is disposed on the right side of the vent plug 70, and the second projecting portion 85 is disposed on the left side of the vent plug 70. In the liquid-holding container 31 that contains the ink, the second projecting portion 85 is disposed on the right side of the vent plug 70, and the first projecting portion 83 is disposed on the left side of the vent ping 70. By using the first projecting portion 83 and the second projecting portion 85, the operator may also distinguish between two types of liquids that have different viscosities.

The cartridge 3 may also be provided with one groove, instead of the two grooves 361 and 362. The cartridge 3 may also be provided with one first opening, instead of the two first openings 371 and 372. The cartridge 3 may be provided with the one first opening in the one groove and the first projecting portion may be caused to project into and engage with the one first opening. The cartridge 3 may also be provided with one second opening, instead of the two second openings 391 and 392. In the cartridge 3, the second projecting portion may be caused to engage with the one second opening. For example, a case that is attached to the liquid-holding container 31 on which the attaching portion 80 is in the first orientation may be provided with the first opening 372, the second opening 391, and the groove 362. A case that is attached to the liquid-holding container 31 on which the attaching portion 80 is in the second orientation may be provided with the first opening 371, the second opening 392, and the groove 361.

It is also acceptable for the grooves 361 and 362 not to be provided. The first openings 371 and 372 may also be provided in portions of the supporting wall portion 34 that are not grooves. In that case, through any one of the first openings 371 and 372, the first engaging nubs 834 of the first projecting portion 83 may engage with the outer face 345 of the supporting wall portion 34 where no grooves are provided. In that case, the first projecting portion 83 would protrude below the outer face 345. The openings 120A to 120F of the cartridge mounting portion 8 may be provided with recessed portions that are recessed downward, instead of being provided with the protuberances 121 and 122. When the cartridges 3 are mounted in the openings 120A to 120F, the first projecting portions 83 and the second projecting portions 85 can pass through the recessed portions.

The first projecting portion 83 and the second projecting portion 85 may also be formed as a single unit with the vent plug 70, instead of being provided separately from the vent plug 70 in the attaching portion 80.

The length of the second projecting portion 85 in the projecting direction needs only to be shorter than the length of the first projecting portion 83 in the projecting direction. The shapes of the first projecting portion 83 and the second projecting portion 85 may also be different from what they are in the present embodiment. Instead of extending in a direction that is orthogonal to the X axis direction, the first projecting portion 83 and the second projecting portion 85 may extend in any direction that intersects the X axis direction, it is also acceptable for the first projecting portion 83 and the second projecting portion 85 not to extend in a direction that is strictly orthogonal to the X axis direction. It is also acceptable for the second projecting portion 85 not to be provided with the portion that elastically deforms and bends at its protruding end portion. Instead, it is acceptable for the second projecting portion 85 to extend in a direction that intersects the face of the liquid-holding bag 13, as with the first projecting portion 83. In this case, the first engaging nubs 834 of the first projecting portion 83 engage with the outer face 345 in the groove 361. It is also acceptable for the first engaging nubs 834 and the second engaging nubs 856 not to be provided. In that case, the first projecting portion 83 and the second projecting portion 85 may engage with the first case 33 by press fitting, for example. It is also acceptable for the holder 90 not to be provided with the extension portion 93 and the projecting portion 94. It is also acceptable for the holder 90 and the electric circuit board 98 not to be provided in the vent plug unit 7. It is also acceptable for the attaching portion 80 not to be provided with the electric circuit board 98. It is also acceptable for the vent plug 70 and the first mounting portion 74 not to be provided in positions that include a position that is at the midpoint between the first engaging nubs 834 and the second engaging nubs 856. It is also acceptable for the first mounting portion 74 and the first support portion 346 not to be provided, it is also acceptable for the second mounting portion 75 and the second support portion 347 not to be provided. It is also acceptable for the second case 40 not to be provided.

The liquid-holding container 31 and the cartridge 3 may also be used by being mounted in a device other than the printer 1. The liquid-holding container 31 and the cartridge 3 may also be used without being mounted in the printer 1 or any other device.

As indicated by the first distance L4 and the second distance L5 in FIGS. 8 and 12, in the left-right direction, in which the first projecting portion 83 and the second projecting portion 85 are disposed opposite one another, the positional relationships of the first projecting portion 83 and the second projecting portion 85 with respect to the vent plug 70 are substantially the same, even if the attaching portion 80 is switched between the first orientation and the second orientation. A different example of these positional relationships will be explained.

Figure 17:
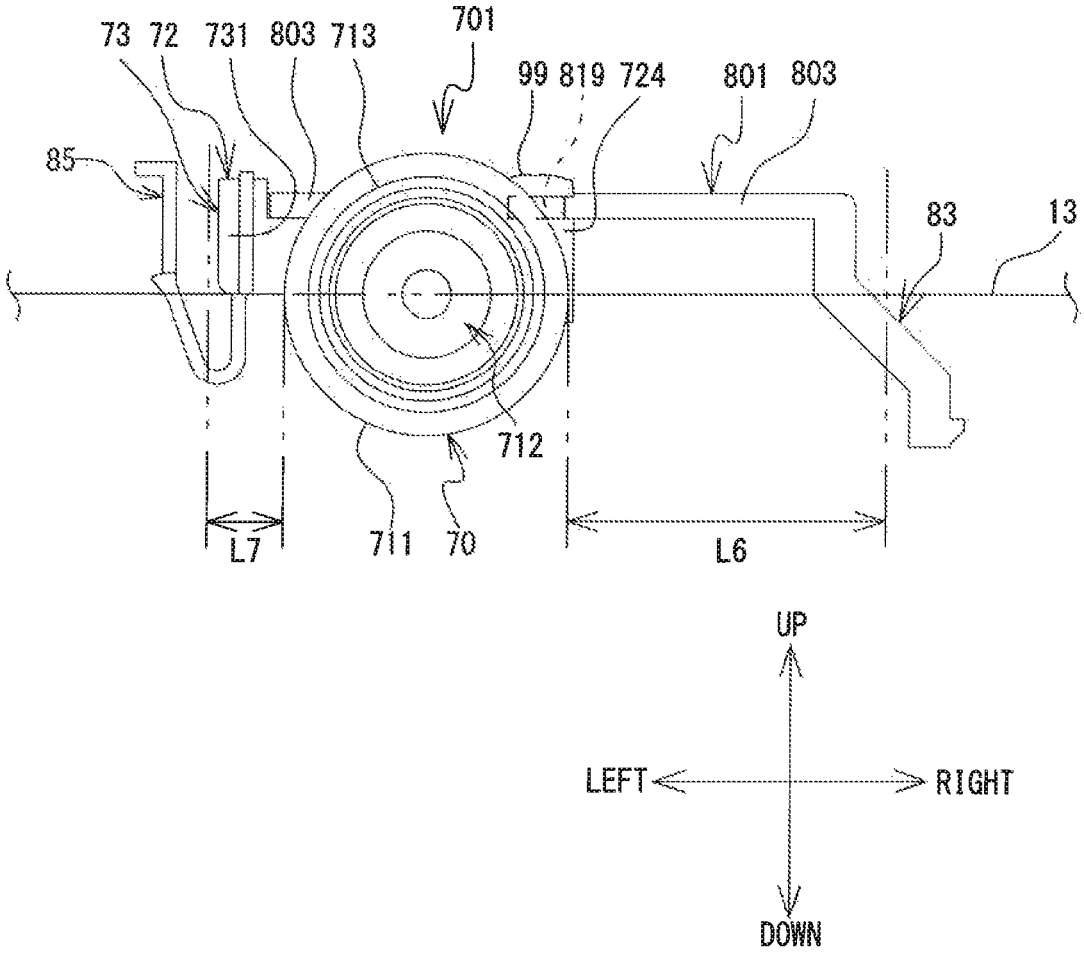
FIG. 17 is a front view of a vent plug unit in which an attaching portion is in a first orientation, according to a modified example.

In a vent plug unit 701 that is shown in FIG. 17, the length in the right portion of a base portion 803 of an attaching portion 801 is longer than the length in the left-right direction of the base portion 81 of the attaching portion 80 in the vent plug unit 7 that is shown in FIG. 8, and the first projecting portion 83 is positioned farther to the right side. The attaching portion 801 is in a first orientation. An engagement hole 819 is provided in the center of the base portion 803 in the left-right direction. The engagement hole 819 penetrates through the base portion 803 in the up-down direction. The engagement hole 819 is above the cylindrical portion 724. The screw 99 engages the attaching portion 801 with the vent plug 70 through the engagement hole 819.

Figure 18:
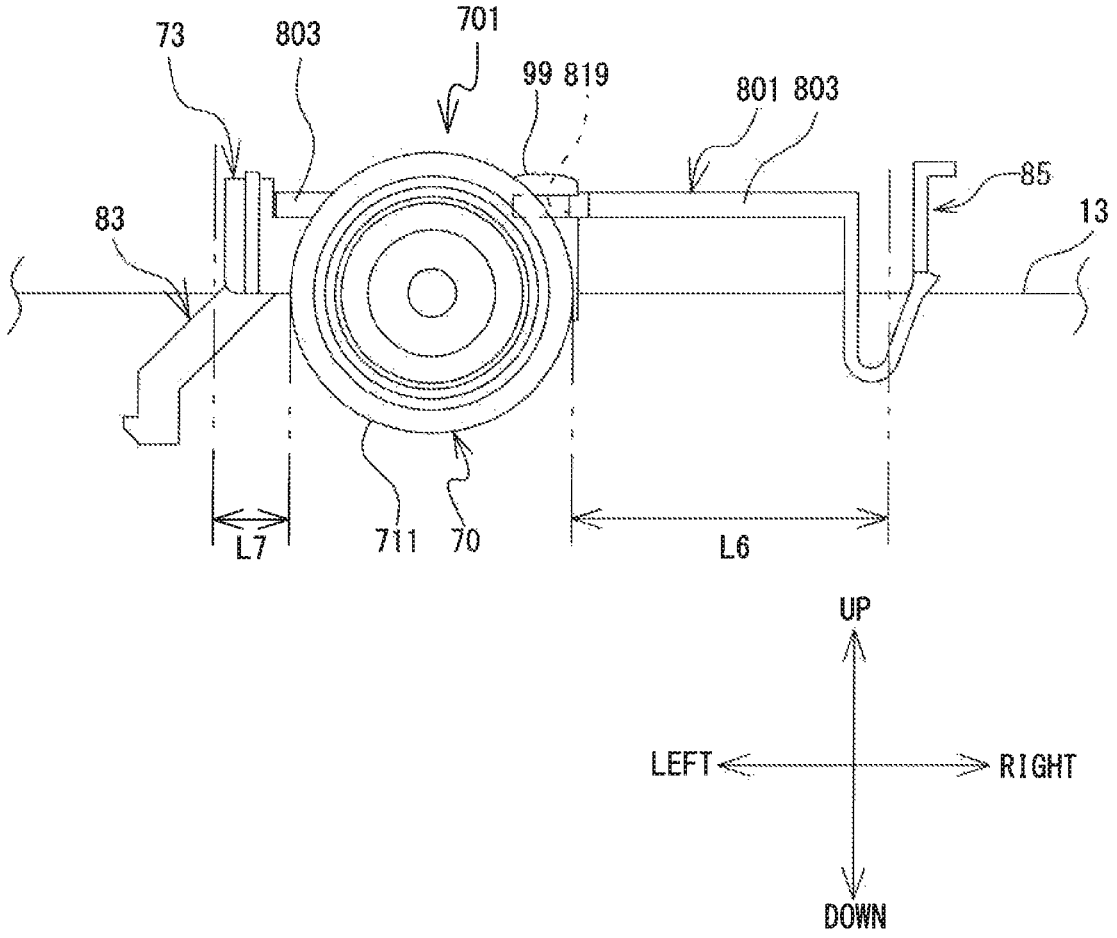
FIG. 18 is a front view of the vent plug unit in which the attaching portion is to a second orientation, according to the modified example.

As shown in FIG. 18, when the attaching portion 801 is in a second orientation, the second projecting portion 85 is positioned farther to the right side than it is in the vent plug unit 7 that is shown in FIG. 12. The engagement hole 819 is above the cylindrical portion 724. The screw 99 (refer to FIG. 9) engages the attaching portion 801 with the vent plug 70 through the engagement hole 819. The base portion 803 is provided with holes (not shown in the drawings) where the protruding portion. 728 (refer to FIG. 9) is disposed in each of the first orientation and the second orientation. The vent plug unit 701 may also be provided with the holder 90 and the electric circuit board 98.

As shown in FIG. 17, the distance in the left-right direction between the center of the first projecting portion 83 in the first orientation and the right edge of the vent plug 70 is defined as a first distance L6. The distance in the left-right direction between the center of the second projecting portion 85 in the first orientation and the left edge of the vent plug 70 is defined as a second distance L7. As shown in FIG. 18, in a case where the attaching portion 801 is in the second orientation, the distance in the left-right direction between the center of the first projecting portion 83 and the vent plug 70 is the second distance L7. The distance in the left-right direction between the center of the second projecting portion 85 and the vent plug 70 is the first distance L6.

Therefore, in the left-right direction, in which the first projecting portion 83 and the second projecting portion 85 are disposed opposite one another, the positional relationships of the first projecting portion 83 and the second projecting portion 85 with respect to the vent plug 70 are substantially the same, even if the attaching portion 801 is switched between the first orientation and the second orientation. In the same manner as in the embodiment that is described above, the operator may easily determine the type of the ink that is contained in the liquid-holding container 31, without considering the positional relationships of the first projecting portion 83 and the second projecting portion 85 with respect to the vent plug 70.

It is also acceptable, in a case where the attaching portion 801 is switched between the first orientation and the second orientation, for the positional relationships of the first projecting portion 83 and the second projecting portion 85 with respect to the vent plug 70 not to be substantially the same in the left-right direction, in which the first projecting portion 83 and the second projecting portion 85 are disposed opposite one another.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A liquid-holding container, comprising:

a liquid container portion that is a flexible and bag-shaped container configured to contain a liquid;

a hollow vent plug that is connected to the liquid container portion, the vent plug including a first plug portion and a second plug portion, the first plug portion being positioned inside the liquid container portion and affixed to the liquid container portion, the second plug portion protruding from the first plug portion toward the outside of the liquid container portion;

a first projecting portion that is positioned outside the liquid container portion and connected to the second plug portion, the first projecting portion extending in a direction that intersects a face of the liquid container portion; and a second projecting portion that is positioned outside the liquid container portion and connected to the second plug portion on the opposite side of the second plug portion from the first projecting portion, the second projecting portion extending in the direction that intersects the face of the liquid container portion, such that the second projecting portion is opposite the first projecting portion, and a length of the second projecting portion from a virtual face that includes an axis of the vent plug being shorter than a length of the first projecting portion from the virtual face.

2. The liquid-holding container according to claim 1, wherein, the second projecting portion bends at a protruding end portion in a direction away from the first projecting portion and then extends towards the liquid container portion.

3. The liquid-holding container according to claim 1, further comprising:

a flat portion that is provided on an outside face of the second plug portion, the flat portion extending in a direction in which the first projecting portion and the second projecting portion are arrayed, and the first projecting portion and the second projecting portion being arrayed on opposite sides of the flat portion.

4. The liquid-holding container according to claim 1, further comprising:

an attaching portion that is a separate unit from the vent plug and that is configured to be attached to the second plug portion, the attaching portion being provided with the first projecting portion and the second projecting portion.

5. The liquid-holding container according to claim 4, further comprising:

an engagement portion that is provided on the attaching portion, the engagement portion being configured to engage with the second plug portion when in one of a first orientation and a second orientation, the first orientation being an orientation in which the first projecting portion is positioned on a first direction side of the vent plug and the second projecting portion is positioned on a second direction side of the vent plug, the first direction side being orthogonal to the axis of the vent plug and parallel to the face of the liquid container portion, the second direction side being the opposite side from the first direction side, and the second orientation being an orientation in which the first projecting portion is positioned on the second direction side of the vent plug and the second projecting portion is positioned on the first direction side of the vent plug.

6. A cartridge, comprising:

the liquid-holding container according to claim 1, and a case that is configured to support the liquid-holding container and includes a supporting wall portion that is configured to support the liquid-holding container and that extends in the axial direction of the vent plug, and a first opening that is provided on one end of the supporting wall portion in the axial direction and that is an opening into which the first projecting portion can protrude.

7. The cartridge according to claim 6, wherein, the case includes at least one groove that is provided on an outer face that is on the opposite side of the supporting wall portion from an inner face on the side where the liquid-holding container is located, the at least one groove being recessed from the supporting wall portion toward the liquid-holding container and extending in the axial direction, and the first opening is provided at one end of the at least one groove.

8. The cartridge according to claim 7, wherein, the at least one groove is a first groove and a second groove, which are two of the at least one groove, the second projecting portion bends at the protruding end portion in the direction away from the first projecting portion and then extends towards the liquid container portion, the first opening is provided in the first groove, the case includes an opening wall portion that is provided on the inner face side of the second groove, the opening wall portion being a wall portion that forms a second opening, and the second opening being open in a direction that intersects an opening face of the first opening, and the second projecting portion is configured to engage with the second opening.

9. The cartridge according to claim 8, wherein, the liquid-holding container includes a first engaging nub that is provided on the first projecting portion, the first engaging nub being a nub portion that is configured to engage with the outer face of the supporting wall portion, and a second engaging nub that is provided on the second projecting portion, the second engaging nub being a nub portion that is configured to engage with an inner side of the second projecting portion.

10. The cartridge according to claim 9, wherein the vent plug is provided in an area that includes a position that is midway between the first engaging nub and the second engaging nub in the direction in which the first projecting portion and the second projecting portion are arrayed.

11. The cartridge according to claim 8, wherein the liquid-holding container includes an attaching portion on which the first projecting portion and the second projecting portion are provided, the attaching portion being a separate unit from the vent plug and being configured to be attached to the vent plug, and an engagement portion that is provided on the attaching portion, the engagement portion being configured to engage with the vent plug when in one of a first orientation and a second orientation, the first orientation being an orientation in which, in relation to the vent plug, the first projecting portion is positioned on a first direction side that is orthogonal to the axis of the vent plug and parallel to the face of the liquid container portion and the second projecting portion is positioned on a second direction side of the vent plug, the second direction side being the opposite side from the first direction side, and the second orientation being an orientation in which the first projecting portion is positioned on the second direction side of the vent plug and the second projecting portion is positioned on the first direction side of the vent plug, the first opening is provided in both the first groove and the second groove, the first opening that is provided in the first groove is provided in a position where the first projecting portion of the attaching portion in the first orientation can protrude the first opening, the first opening that is provided in the second groove is provided in a position where the first projecting portion of the attaching portion in the second orientation can protrude the first opening, the opening wall portion is provided on the inner face sides of both the first groove and the second groove, the opening wall portion that is provided on the inner face side of the first groove is provided in a position where the second projecting portion of the attaching portion in the second orientation can engage with the opening wall portion, and the opening wall portion that is provided on the inner face side of the second groove is provided in a position where the second projecting portion of the attaching portion in the first orientation can engage with the opening wall portion.

12. The liquid-holding container according to claim 1, wherein the liquid container portion is formed from two sheets that face each other, and the first projecting portion and the second projecting portion extend in the direction in which the two sheets face each other.

13. The liquid-holding container according to claim 12, wherein each of the length of the first projecting portion from the virtual face and the length of the second projecting portion from the virtual face is a length in the direction in which the two sheets face each other.

14. The liquid-holding container according to claim 12, wherein the second projecting portion bends at a protruding end portion in a direction away from the first projecting portion and then extends towards the liquid container portion, the direction away from the first projecting portion being a direction orthogonal to the direction in which the two sheets face each other.

15. The liquid-holding container according to claim 14, wherein a flat portion that is provided on an outside face of the second plug portion, the flat portion extending in a direction in which the first projecting portion and the second projecting portion are arrayed, and the first projecting portion and the second projecting portion being arrayed on opposite sides of the flat portion, the flat portion extending in the direction orthogonal to the direction in which the two sheets face each other.

* * * * *